US006190216B1

(12) United States Patent
King

(10) Patent No.: US 6,190,216 B1
(45) Date of Patent: Feb. 20, 2001

(54) TROLLING MOTOR CONTROL APPARATUS

(76) Inventor: Terry King, 546 Johnson King Rd., Swansea, SC (US) 29160

( * ) Notice: Under 35 U.S.C. 154(b), the term of this patent shall be extended for 0 days.

(21) Appl. No.: 09/312,867

(22) Filed: May 17, 1999

Related U.S. Application Data

(63) Continuation-in-part of application No. 08/609,246, filed on Mar. 1, 1996, now Pat. No. 5,954,551, which is a continuation-in-part of application No. 08/381,778, filed on Feb. 1, 1995, now Pat. No. 5,496,198, which is a continuation-in-part of application No. 08/164,007, filed on Dec. 8, 1993, now abandoned.

(51) Int. Cl.[7] ..... B60L 11/02
(52) U.S. Cl. ..... 440/6; 440/7; 440/87
(58) Field of Search ..... 114/144 R, 363, 114/153; 440/6, 7

(56) References Cited

U.S. PATENT DOCUMENTS

| | | | | |
|---|---|---|---|---|
| 4,631,034 | * | 12/1986 | Menne et al. | 440/7 |
| 4,854,902 | * | 8/1989 | Havins | 440/7 |
| 5,207,604 | * | 5/1993 | McMillin | 114/144 R |
| 5,892,338 | * | 4/1999 | Moore et al. | 440/7 |
| 5,954,551 | * | 9/1999 | King | 440/7 |

* cited by examiner

*Primary Examiner*—Stephen Avila

(57) ABSTRACT

An apparatus for controlling a trolling motor, comprising a foot operable control assembly with a rotatable plate operationally connected to the trolling motor so that the rotational motion of the plate will rotate the trolling motor to steer the boat. In one embodiment, the means to activate the trolling motor speeds are operationally connected to the trolling motor and placed in a circle around the rotatable control plate. In another embodiment the operator can place a chair on the rotatable plate to steer the boat and activate the trolling motor speeds with his foot. In still another embodiment the control assembly has a rotatable shaft with a chair attached to steer the boat and the trolling motor speed control means are operatively connected to the trolling motor and placed remotely from the control assembly so that the speed control means are accessible to the foot of an operator. In the embodiments above the means operatively connecting the speed control assembly to the trolling motor comprises electric means but the speed control means may be operatively connected to the trolling motor by wireless electronic means, such as radio frequency, infrared signals or any other wireless means. Additionally, the means operatively connecting the trolling motor to the control assembly for controlling the rotation of the trolling motor on an axis to steer the boat are mechanical, but these means may be comprised of electrical or wireless electronic means, such as radio frequency, infrared signals or any other suitable means.

35 Claims, 17 Drawing Sheets

FIG. 3
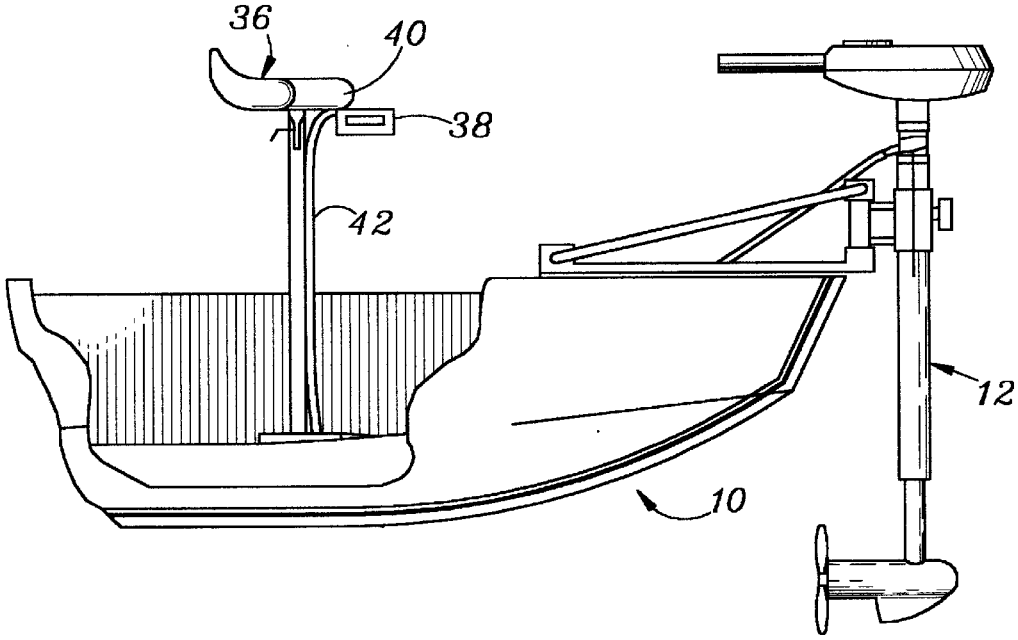
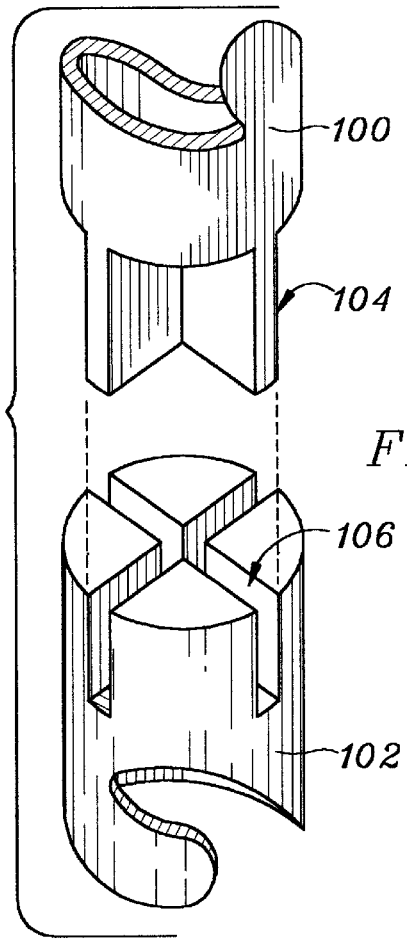
FIG. 10

FIG. 22
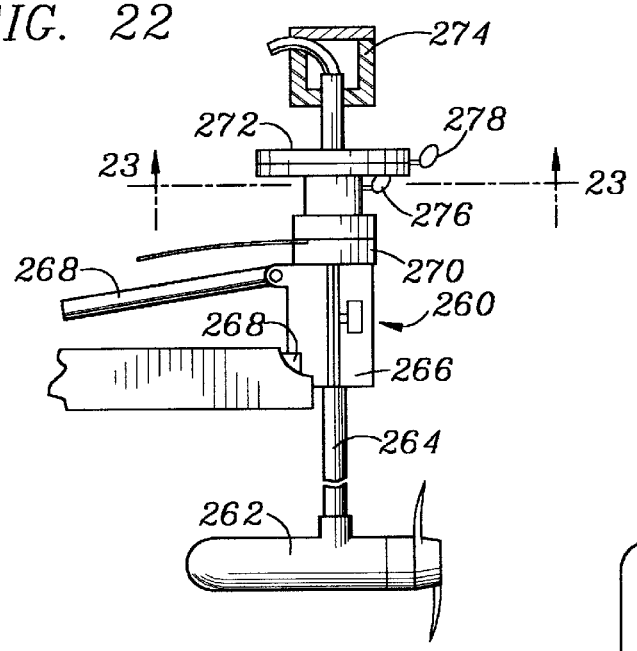
FIG. 23
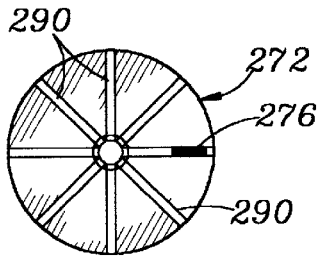
FIG. 24b
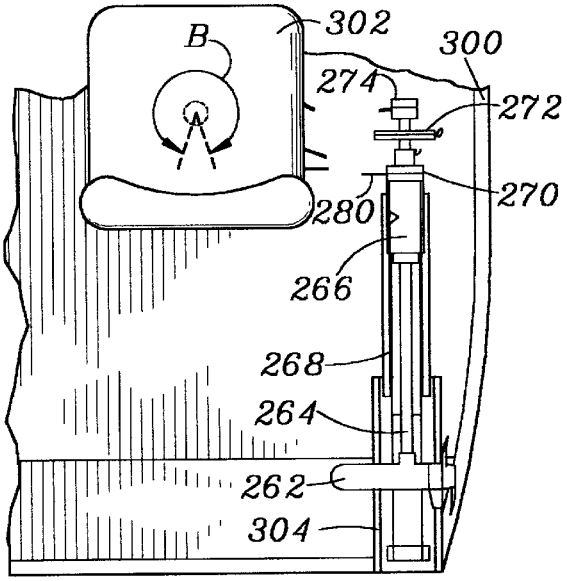
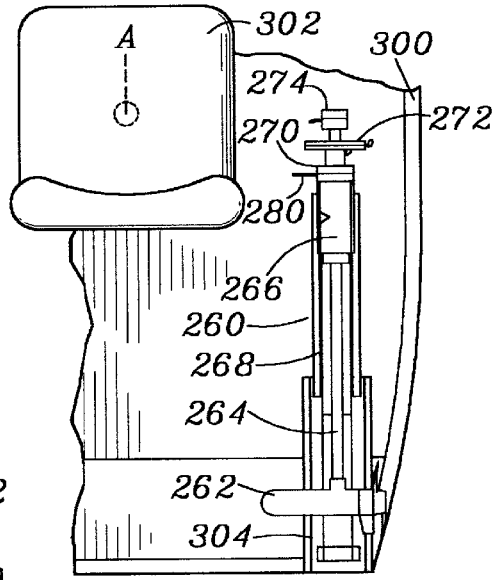
FIG. 24a

FIG. 28a
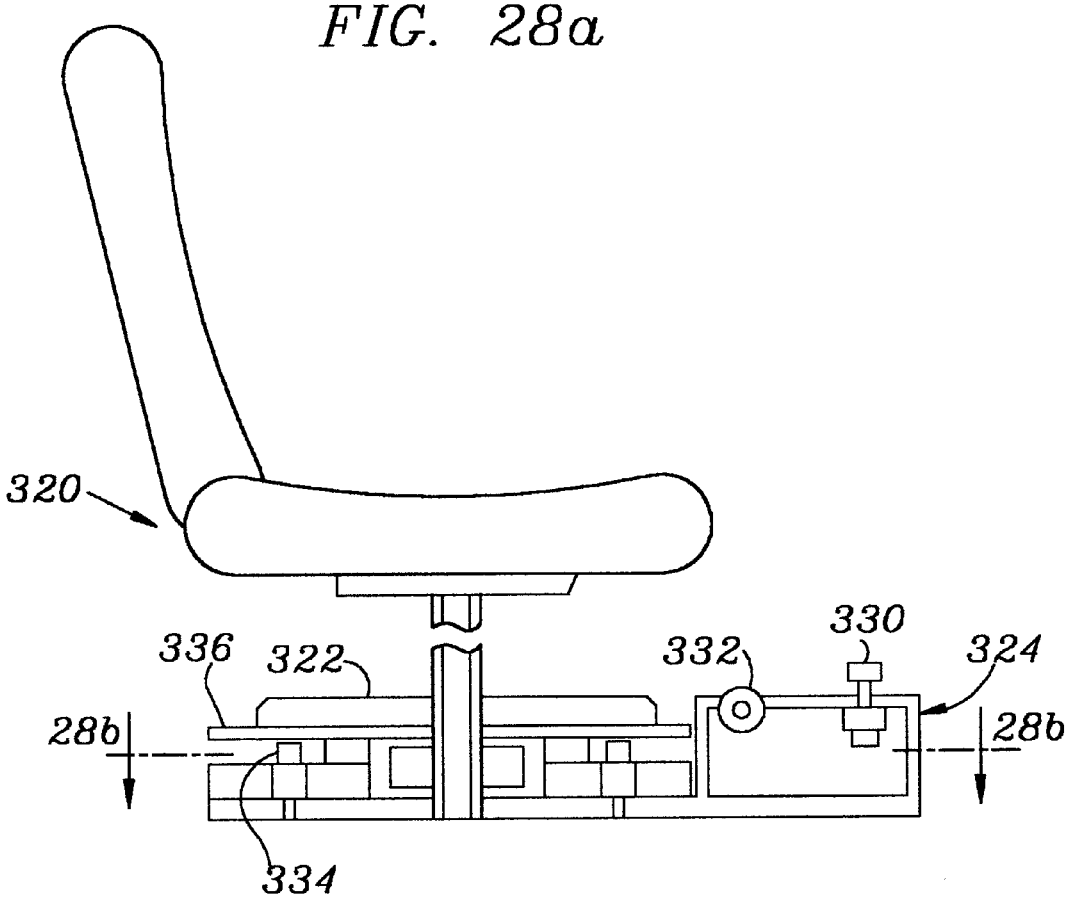
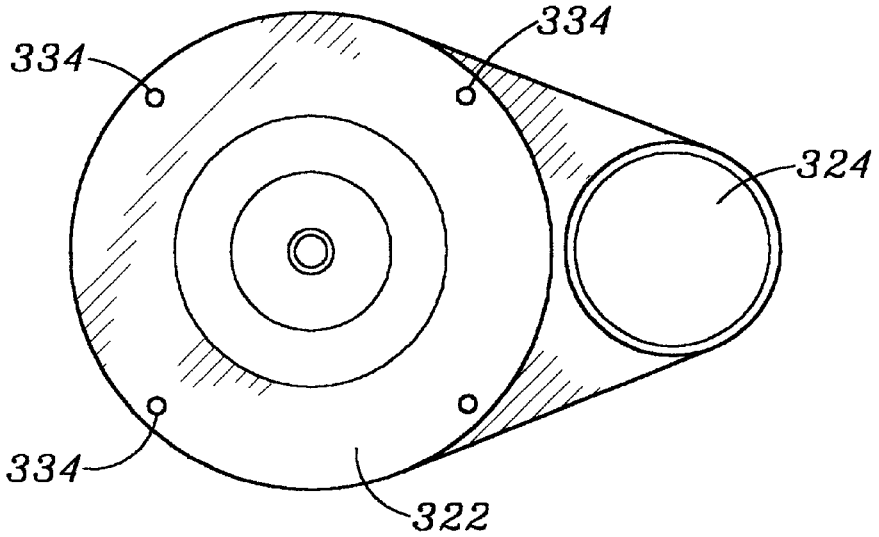
FIG. 28b

TROLLING MOTOR CONTROL APPARATUS

This application is a continuation-in-part of application Ser. No. 08/609,246, filed Mar. 01, 1996, which resulted in U.S. Pat. No. 5,954,551 dated Apr. 21, 1999, which is a continuation-in-part of application Ser. No. 08/381,778, filed Feb. 1, 1995, which resulted in U.S. Pat. No. 5,496,198 dated Mar. 5, 1996, which is a continuation-in-part of application Ser. No. 08/164,007, filed Dec. 8, 1993, now abandoned.

BACKGROUND OF THE INVENTION

1. Field of the Invention

The present invention relates generally to the operation of trolling motors used with fishing boats. In particular, the present invention relates to an apparatus that allows a user to operate a trolling motor with his foot to maneuver a boat on water. The present invention also relates to an apparatus that has a rotatable chair attached so that a user can steer the boat with the chair and control the boat speed with his foot.

2. Discussion of Background

Fishing boats come in a variety of styles and with a variety of equipment. A fishing boat may be equipped with an inboard or outboard motor for propelling the boat from place to place on a body of water such as a lake or stream. Many boats are also equipped with the small outboard electric motors commonly known as "trolling motors." A trolling motor is usually smaller, quieter, and less powerful than the main outboard motor of the boat, thus, it is useful for maneuvering the boat quietly and slowly across the water. In a boat so equipped, a fisherman can fish while the boat is under way (propelled by the trolling motor), and/or after the boat has stopped. If the boat is in a moving body of water, the trolling motor can be used to maintain or restore the position of the boat. The use of a trolling motor maximizes the options available to the fisherman.

Trolling motors may be controlled by foot-operated controls, hand-operated controls, chair operated controls, or a combination thereof. For example, the angle of the motor (thus, the direction of travel of the boat) may be controlled by a tiller that controls the angle of the motor; and the motor head may have and on/off switch, speed control, and forward/reverse switch. In some types of motors, some or all of these may be replaced by foot-operated switches. Many users find that foot-operated controls are more convenient for use while fishing. Although such foot-operated control systems provide the fisherman with free use of his hands, presently-available systems may be inconvenient or difficult to operate.

The most common complaint about presently available trolling motor control devices is the necessity for the user to constantly reposition his body and, or the device, while simultaneously managing fishing equipment and controlling the movement of the boat. This invention does not merely simplify this set of tasks; it actually eliminates any need for a fisherman to position his foot to a specific orientation of the foot to the control assembly or reposition his foot on the control assembly to control all the speeds of the trolling motor while actively steering the boat.

This invention also allows an operator to use a chair rotationally connected to the trolling motor to steer the boat and control all the speeds of the boat with his foot (or leg). Regardless of the orientation of the chair to the speed control means. The operator may steer the boat while he is seated in the chair or if he wishes, he can stand near the chair and rotate the chair as if it were a steering wheel to steer the boat.

SUMMARY OF THE INVENTION

In a preferred embodiment, this invention is a foot operable trolling motor control assembly that is formed to receive an optional chair. The apparatus contains a control plate rotationally connected to the shaft of a trolling motor so that the boat will travel in the direction that the plate is rotated, additionally the operator has the option of placing a chair on the control assembly so that the trolling motor will rotate in the direction that the chair is rotated.

The control assembly has trolling motor activation means to activate all the speeds of the trolling motor. The activation means are placed in a circle around the control assembly so that when an operator is actively steering the boat with his foot (or chair if attached). The activation means are accessible to the foot of the operator regardless of the orientation of the foot (or chair) to the control assembly. While steering the boat with his foot the operator simply presses lightly on the outer rim of the control assembly with the front portion of his foot to obtain a first speed of the trolling motor. The operator presses a little harder for a second speed and even harder for a third speed, etc. If the operator wishes, he can place an optional chair on the control assembly control plate so that the rotation of the chair is used to steer the boat. While steering the boat with the chair the operator simply presses on the outer ring of the control assembly with the heel of his foot to obtain all the speeds of the trolling motor. This ring is accessible to the operator's foot regardless of the orientation of the chair to the control assembly. The control assembly can even be adjusted so that the operator can activate the speeds of the trolling motor by simply leaning back on the chair.

The operator also has the option to place the chair in any orientation with respect to the direction the boat is traveling. Therefore the operator can face the bank of a lake while casting for fish and have the boat travel parallel to the bank.

The apparatus even has a light to represent each speed of the trolling motor operatively connected to the control assembly so that the operator knows the speed the boat is traveling at all times.

The apparatus also contains a direction arrow so that the operator will know the direction that the trolling motor is facing in relation to the boat at all times. This direction arrow is not necessary when a chair is attached to the control assembly because the operator has a perfect feeling for the direction the boat will travel when the operator rotates the chair because the operator knows the boat will travel in the direction the chair is rotated, but the direction arrow is important when there is no chair attached to the control assembly and the operator is steering the boat with his foot.

The trolling motor can be placed on the front or the back of the boat as desired and the boat will travel in the direction the control plate or chair is rotated.

In another preferred embodiment of the invention, the chair is attached to the shaft of the control assembly so that the boat can be steered by the rotation of the chair. The activation means are placed on the boat in convenient positions at least partially surrounding the control assembly so that the activation means are accessible to the foot of the operator regardless of how far the operator has to rotate the chair to steer the boat in all directions.

In still another embodiment, the chair is on the control assembly and the activation means are carried by the boat and positioned near the control assembly and the operator has the option of placing the activation switches anywhere he wishes on the deck of the boat so that the switches are accessible to the foot of the operator while he steers the boat with the chair.

In still another embodiment, the activation means are placed on the foot operable control plate and rotate with the plate so the activation means are accessible to the foot of the operator while he is steering the boat in all directions. The switches could be placed on the control plate so that all the speeds of the trolling motor are accessible to the foot of the operator so that the operator can access all the speeds of the trolling motor while actively steering the boat without having to remove or reposition his foot on the control plate. Optionally the speed control means could be operatively connected to the trolling motor and placed near the control assembly and all the speeds of the trolling motor could be controlled with the foot by pressing the foot on the speed the operator wishes the boat to travel.

In all the embodiments of the invention listed above the control assembly and trolling motor are operatively connected with two pull cables so that when the control assembly is rotated in one direction the boat will travel in a corresponding direction but the control assembly and trolling motor could be operatively connected by any mechanical, electrical or wireless electronic means, such as radio signals, infrared signals, radar signals or any other suitable means, to control the direction of travel and, or the speed of a boat.

Other features and advantages of the present invention will be apparent to those skilled in the art of trolling motor control from a careful reading of the Detailed Description of Preferred Embodiments presented below and accompanied by the drawings.

BRIEF DESCRIPTION OF THE DRAWINGS

In the drawings,

FIG. 3 is a side view, partially cut away, of a boat with a trolling motor mounted to the front of the boat and controlled in accordance with another preferred embodiment of the present invention;

FIG. 10 is a detailed, exploded view of the seating of the chair shaft to the bearing assembly in accordance with a preferred embodiment of the present invention;

FIG. 22 is a side, partially cross sectional view of a trolling motor according to another preferred embodiment of the present invention;

FIG. 23 illustrates the direction plate shown in FIG. 22, along the lines 23—23 of FIG. 22;

FIGS. 24*a* and 24*b* are top views of a portion of a boat equipped with a trolling motor and a control apparatus according to the present invention, showing the trolling motor in a stowed position with the direction plate engaged and disengaged, respectively;

FIGS. 28*a* and 28*b* show a chair mounted to a bearing assembly with foot-operable controls according to another preferred embodiment of the present invention;

DETAILED DESCRIPTION OF PREFERRED EMBODIMENTS

Figure 1:
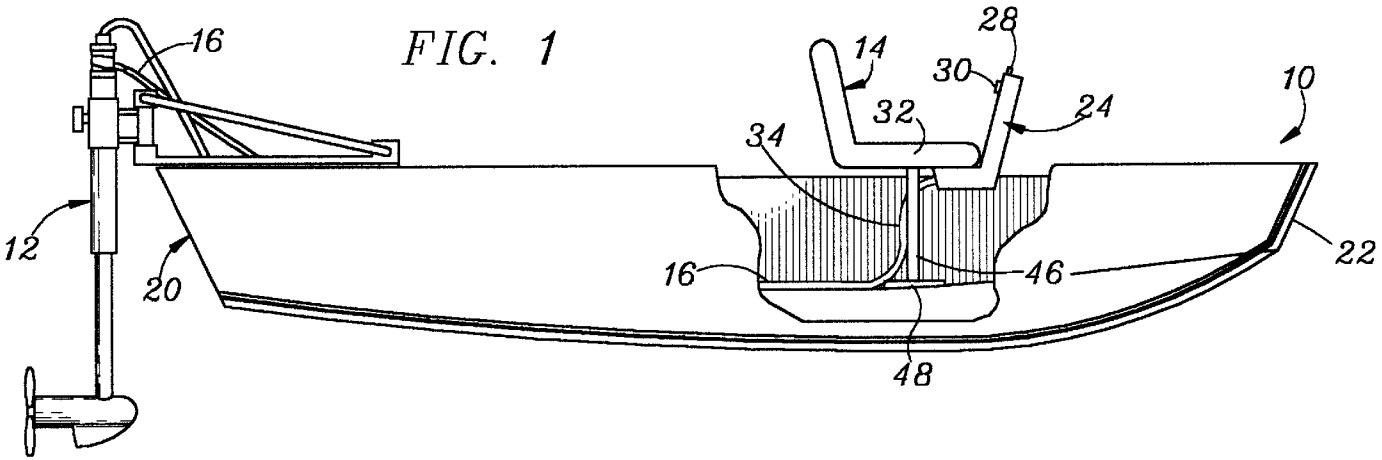
FIG. 1 is a side view, partially cut away, of a boat with a trolling motor mounted to the back of the boat and controlled in accordance with a preferred embodiment of the 20 present invention.

In the following description, like reference numerals are intended to identify the same structural elements, portions of surfaces consistently throughout the drawings, as such elements, portions or surfaces may be further described or explained by the entire written specification.

The present invention is a method and apparatus for controlling the trolling motor of a fishing boat—its activation, direction of orientation, speed, and polarity—using a variety of techniques that make control simple and convenient for the user, regardless of whether the user is sitting of standing. Generally, trolling motor controls are positioned on the motor itself. However, these controls are out of a fisherman's reach when he is not directly by the motor, for example, when sitting on a fishing chair (including the type of chair known as a "high seat") in the boat, standing in the back or front of the boat, etc. The present invention enables a fisherman to control the trolling motor in a "hands free" mode, thereby allowing more complete concentration on the act of fishing. In a preferred embodiment of the present invention, the fisherman uses foot-operated controls to start and stop the motor, to adjust the speed of the motor, and to rotate the motor to change the direction of travel of the boat. In another embodiment of the invention, he or she rotates a chair to rotate the motor. If desired, the trolling motor can be readily decoupled from the seat controls, so that the fisherman can swivel the chair without rotating the motor.

Figure 2:
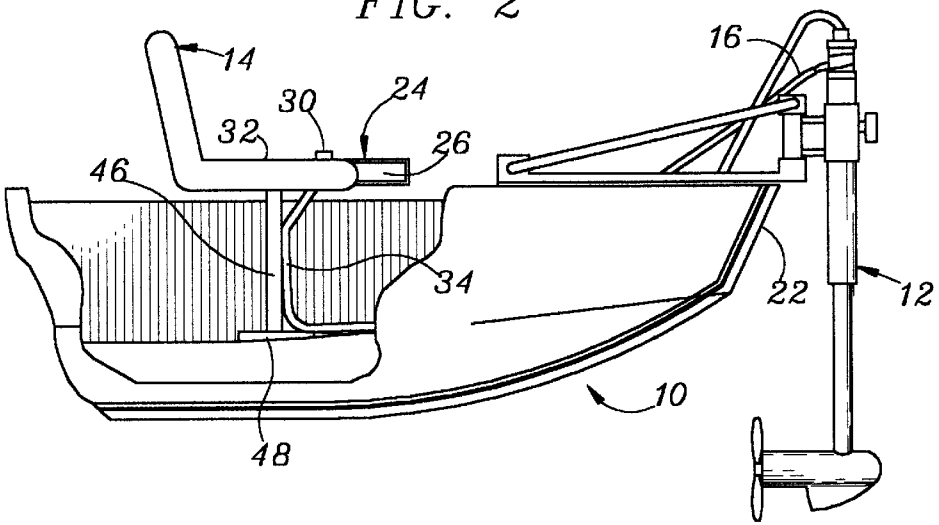
FIG. 2 is a partial side view, partially cut away, of a boat with a trolling motor mounted to the front of the boat and controlled in accordance with a preferred embodiment of the present invention.

Referring now to FIGS. 1 and 2, there is shown a preferred embodiment of the present invention mounted to a boat 10 having a battery-operated trolling motor 12 and a swivel chair assembly 14. Trolling motor 12 is preferably battery-operated; however, other means of supplying power to motor 12 are within the spirit of the present invention. Chair assembly 14 is preferably connected to trolling motor 12 by a cable assembly 16, to be described in more detail below.

In FIG. 1, trolling motor 12 is mounted to a back or stern 20 of boat 10, where motor 12 will push boat 10; in FIG. 2, trolling motor 12 is mounted to a front 22 of boat 10 where it will pull boat 10. The location of motor 12 is based on the type of boat, the type of fishing to be done, and the personal choice of the user. Boat 10 may also be equipped with an outboard or inboard motor; the motor is not shown and is not part of the present invention.

For controlling motor 12 from chair assembly 14, a control panel 24 is attached to a seat 32 of chair assembly 14. Control panel 24 includes an "on/off," or preferably a "forward/off/reverse" switch 26 that activates motor 12, a polarity switch 28 that reverses the direction of rotation of motor 12, and a speed control switch 30 that allows one or more different speeds of motor 12 to be selected. FIG. 1 illustrates control panel 24 mounted so that the panel is between the knees of a user. Control panel 24 is connected electrically to trolling motor 12 by and electrical cable 34.

FIG. 2 illustrates an alternative embodiment wherein control panel 24 is mounted to the side of seat 32 where it is just outside the user's left knee. FIG. 3 shows still another embodiment wherein a high swivel chair (or "high seat") 36 has a control panel 38 mounted to a seat 40 for a fisherman to be seated higher than in the case of seat 32. Control panel 38 is positioned to be between the thighs of the user when the user is leaning against seat 40, and is connected to trolling motor 12 by and electrical cable 42. Preferred alternative embodiments of the present invention for use with a high swivel chair or with the chair removed will be described further below.

Figure 4:
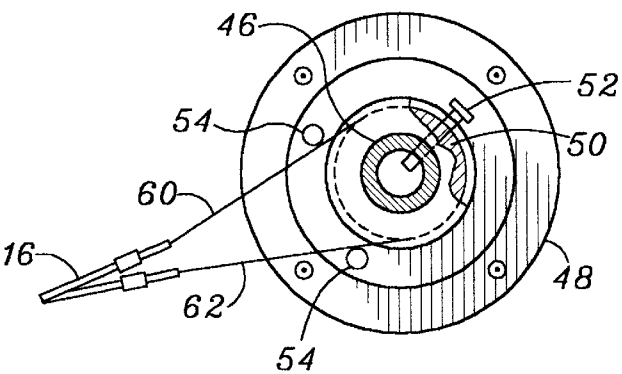
FIG. 4 is a top, partially cut away view of the pulley on the shaft of the chair in accordance with a preferred embodiment of the present invention.
Figure 5:
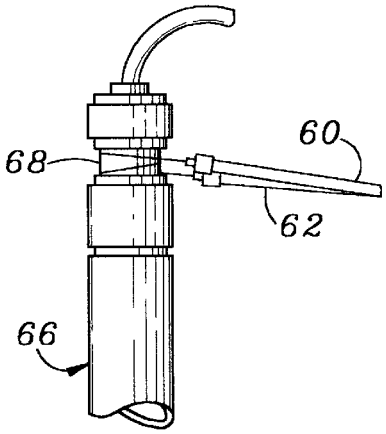
FIG. 5 is a side view of the pulley of the shaft of the trolling motor in accordance with a preferred embodiment of the present invention.

FIGS. 4 and 5 illustrate the details of the attachment of cable assembly 16 to swivel chair assembly 14 and trolling motor 12. Swivel chair assembly 14 has a shaft 46 that rotates with respect to boat 10 in a bearing assembly 48. Attached to shaft 46 and rotatable therewith is a pulley 50. Pulley 50 has a bolt 52 that travels between two stops 54; thus, when bolt 52 reaches either stop 54, it can go no further. Stops 54 are approximately 270° apart in order to give swivel chair assembly 14 a total of approximately 270° of rotation (that is, approximately 135° to either side of a forward facing position). It will be evident that a single stop 54 can be used in lieu of two stops to provide as much as 350° of rotation of assembly 14 and twice that (700° rotation) of trolling motor 12.

A pair of cables, a first cable 60 and a second cable 62, run around the circumference of pulley 50 at least as far as bolt 52, as shown, and preferably somewhat farther to maintain tension on cables 60, 62 throughout their full range of motion. Cables 60, 62 are brought together to travel to trolling motor 12 via cable assembly 16. As pulley 50 rotates in one direction, it pulls first cable 60; when pulley 50 rotates in the opposite direction, it pulls second cable 62.

Trolling motor 12 also has a shaft 66 with a pulley 68. First cable 60 and second cable 62 are connected to shaft 66 in a fashion similar to that used to connect the cables to pulley 50, except that first cable 60 is preferably positioned higher on shaft 66 than second cable 62 to prevent cable fouling. For reasons that will be set forth presently, the ratio of the diameter of the pulley 50 to the diameter of pulley 68 is preferably approximately two, so that, for each degree of rotation of pulley 50, pulley 68 rotates two degrees. However, the diameters of pulleys 50, 68 may be selected so that each degree of rotation of pulley 50 produces a degree of rotation of pulley 60. Alternatively, other ratios may be used if desired.

Figure 6:
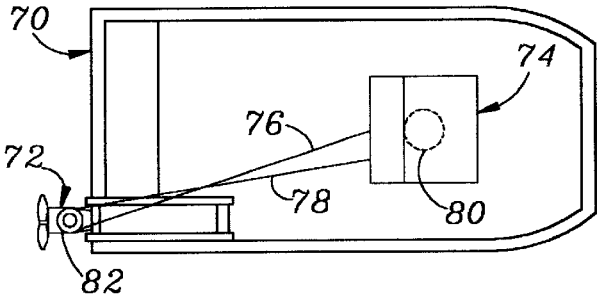
FIG. 6 is a top view of a boat with a trolling motor mounted to the back of the boat and controlled in accordance with the present invention.

FIG. 6 and FIGS. 7*a*–7*e* illustrate the specific operation of the present invention and its advantages. FIG. 6 shows a boat 70 with a motor 72 mounted on the back thereof. Swivel chair assembly 74 faces forward; motor 72 faces forward so that the motor can propel boat 70 forward. Cables 76 and 78 are shown crossing as they run from a first pulley 80 rotating with chair assembly 74 to a second pulley 82 rotating with motor 72.

Figure 7A:
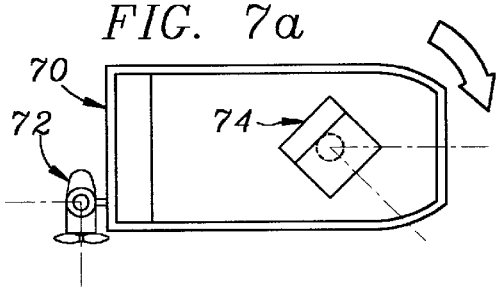
FIGS. 7*a–e* depict the boat of FIG. 6 with the seat rotated and the polarity of the trolling motor set in several different configurations.

FIG. 7*a* shows chair assembly 74 rotated to the right. Right rotation of chair assembly 74 rotates trolling motor 72 to face to the left, where motor 72 will push boat 70 so that the boat swings to the right (in the direction of rotation of chair assembly 74). If the diameters of pulleys 50, 68 are in the above-described 2:1 ratio, a 45° rotation of chair assembly 74 produces a 90° rotation of motor 72.

Figure 7B:
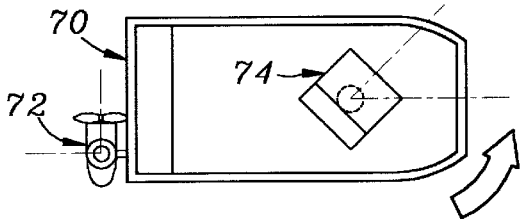
Figure 7E:
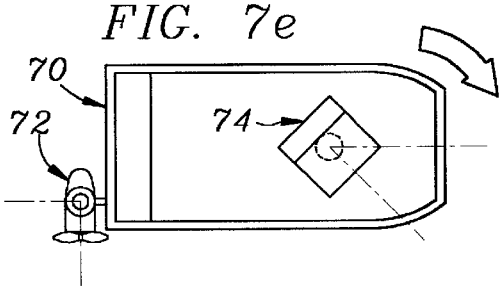

FIG. 7*b* shows a rotation of chair assembly 74 to the left by 45°, with a corresponding rotation of motor 72 to face the right by 90°, where the motor will push boat 70 to the left (again, in the direction chair assembly 74 was rotated).

Figure 7C:
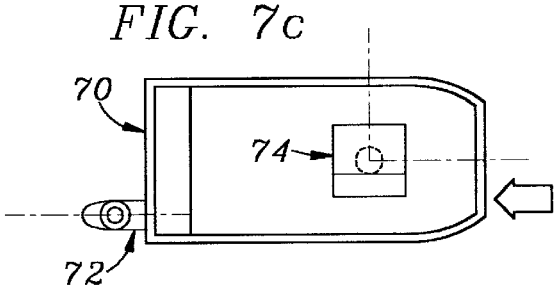
Figure 7D:
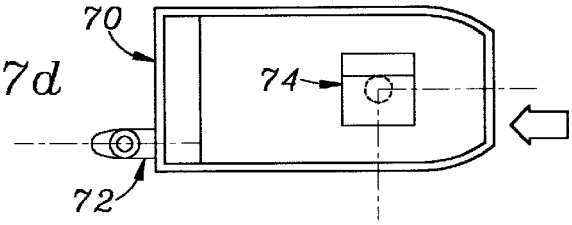

By rotating chair assembly 74 by 90° to either side of boat 70 so that motor 72 rotates 180° (as shown in FIGS. 7*c* and 7*d*) and reversing the polarity of motor 72 using switch 28 on control panel 24 (see FIG. 1), the user can fish to the side of boat 70 while it moves forward and parallel to the shore, or maintain a position parallel to the shore and headed into a stream current. Finally, in backing up boat 70 (FIG. 7*e*), the polarity of motor 72 is reversed using switch 28, and chair assembly 74 is rotated so that the user can look over his shoulder in the direction he wants boat 70 to go. Motor 72 rotates boat 70 as indicated by the arrow and moves the boat backwards, thus turning boat 70 to the left, as illustrated when chair assembly 74 is rotated to the right, resulting in an overall movement of boat 70 rearward and to the right.

Figure 8:
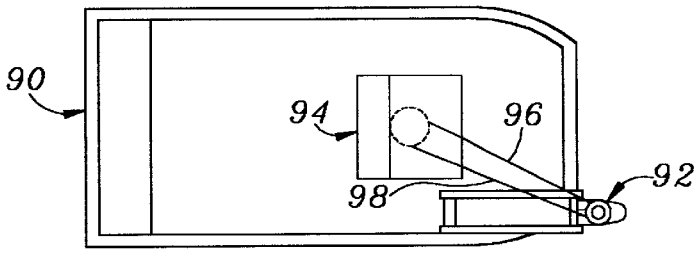
FIG. 8 is a top view of a boat with a trolling motor mounted to the front of the boat and controlled in accordance with the present invention.
Figure 9A:
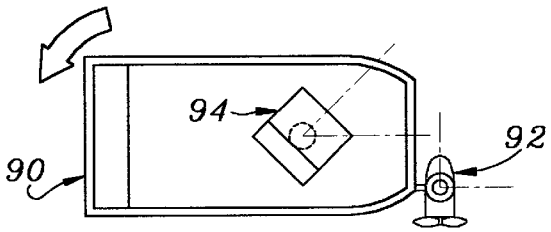
FIGS. 9*a–e* depict the boat of FIG. 8 with the seat rotated and the polarity of the trolling motor set in several different configurations.
Figure 9B:
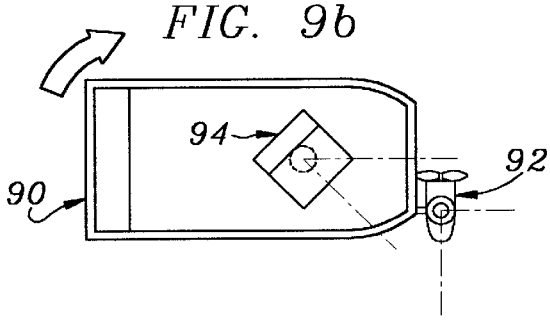
Figure 9C:
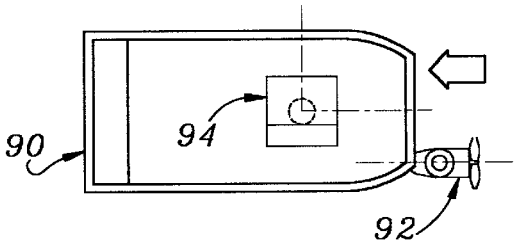
Figure 9D:
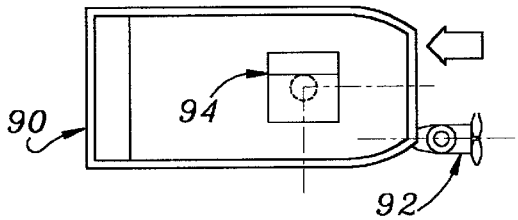

FIG. 8 illustrates a boat 90 with a motor 92 mounted in the front of the boat and connected to a swivel chair assembly 94 by a first cable 96 and a second cable 98. First and second cables 96, 98 do not cross so that motor 92 will turn in the same direction as chair assembly 94. As seen in FIGS. 9*a* and 9*b*, rotation of chair assembly 94 to the left causes motor 92 to rotate to the left, where assembly 94 rotates boat 90 to the left (corresponding to the direction of rotation of assembly 94); correspondingly, rotation of chair assembly 94 to the right rotates motor 92 to the right, rotating boat 90 to the right. As with a rear-mounted motor, rotation of chair assembly 94 by 90° to either side of boat 90, thereby rotating motor 92 by 180°, and reversing the polarity of motor 92 with switch 28, will enable fishing from the side of boat 90 as it is propelled parallel to shore, as illustrated in FIGS. 9*c* and 9*d*.

Figure 9E:
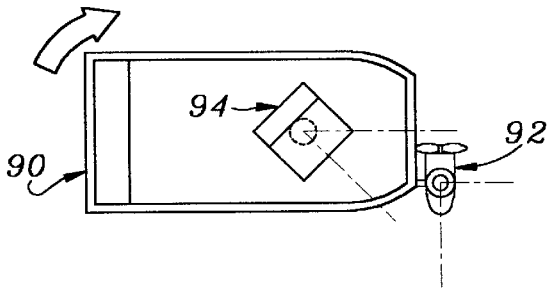

Backing up is performed as described above for a rear-mounted motor: the user rotates chair assembly 94 (FIG. 9*e*) with polarity switch 28 in the reverse direction, so that he can look over his shoulder in the direction he desires to move boat 90.

FIG. 10 illustrates a coupling for a swivel chair shaft 100 to bearing 102. The end of shaft 100 has a cruciform shape 104 and fits into a corresponding double-grooved recess 106 in bearing 102, but allows the chair to be readily lifted and repositioned.

Figure 11A:
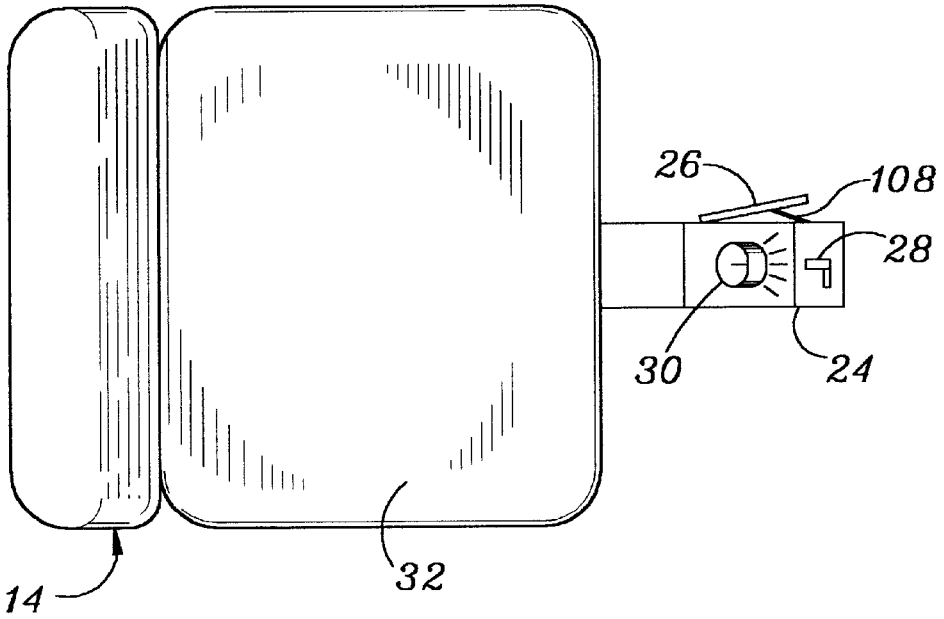
FIGS. 11*a* and 11*b* are a top view and a side view, respectively, of a control panel according to a preferred embodiment of the present invention.
Figure 11B:
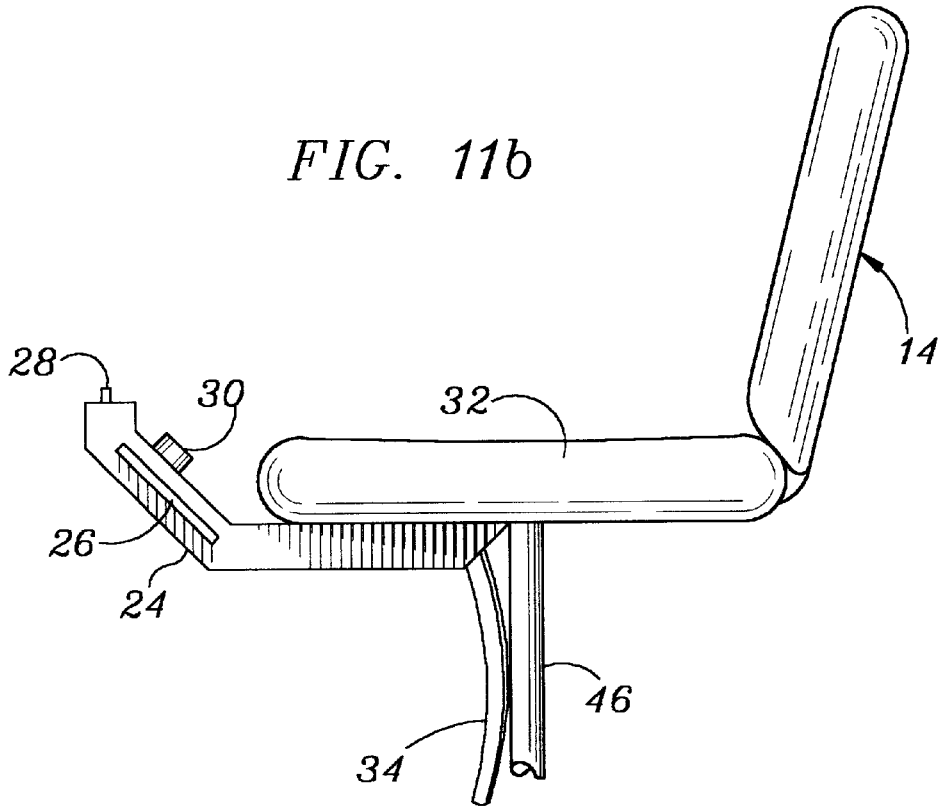

FIGS. 11*a* and 11*b* illustrate an embodiment of control panel 24. Control panel 24 is shown attached approximately to the middle of seat 32 so that on/off switch 26 is adjacent a user's knee on the inside of the leg, where movement of the leg presses switch 26 against a spring 108 to move switch 26 from the "off" position to the "on" position. This placement of switch 26 constitutes a safety feature because it requires continued pressure against the switch to keep the trolling motor in operation. This placement also enables the user to readily control the movement of boat 10 while leaving both hands free to handle fishing equipment. Control panel 24 also has polarity switch 28 and speed control switch 30. Speed control switch 30 can be of the type where specific speeds are selected or a continuous speed control switch similar to a rheostat, as may be preferred. On/off switch 26, polarity switch 28, and speed control switch 30 are connected to motor 12 (FIG. 1) via a cable 34, and are in series with a battery 15 (not shown) for operating motor 12.

Figure 12:
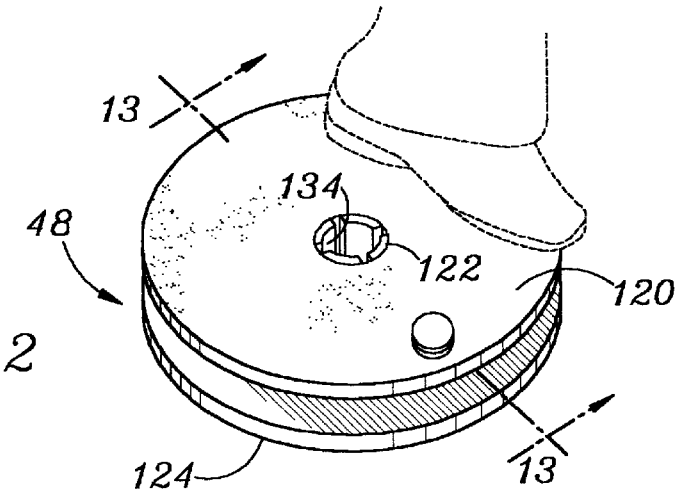
FIG. 12 illustrates the bearing assembly and an alternative embodiment of engagement with the shaft of a chair.
Figure 13:
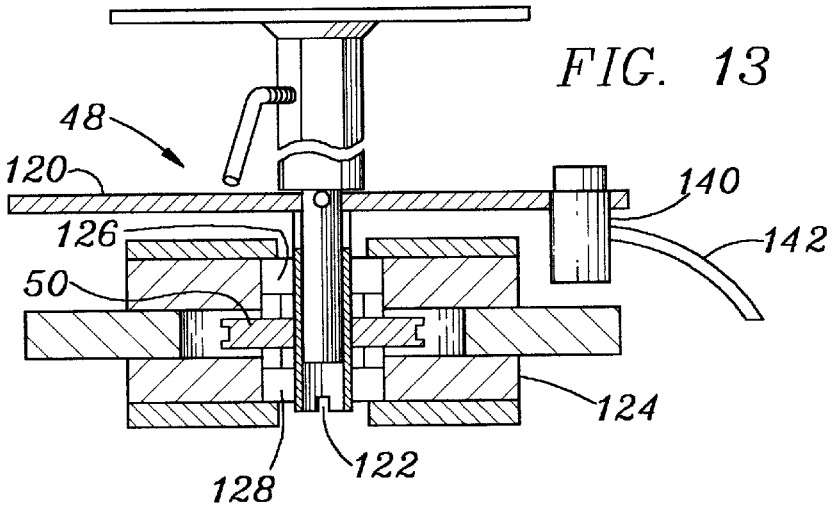
FIG. 13 is a perspective view of an alternative means for controlling the trolling motor in accordance with the present invention.

FIGS. 12 and 13 illustrate bearing assembly 48 in cross section. Bearing assembly 48 includes a top plate 120 surrounding an interior shaft 122 which tuns freely with top plate 120. Pulley 50 is attached to shaft 122 so that the pulley rotates with the shaft. Bearing assembly 48 has a bearing housing 124 having two bearings 126, 128 in engagement with shaft 122 so that the shaft rotates freely within the bearing housing.

Figure 14:
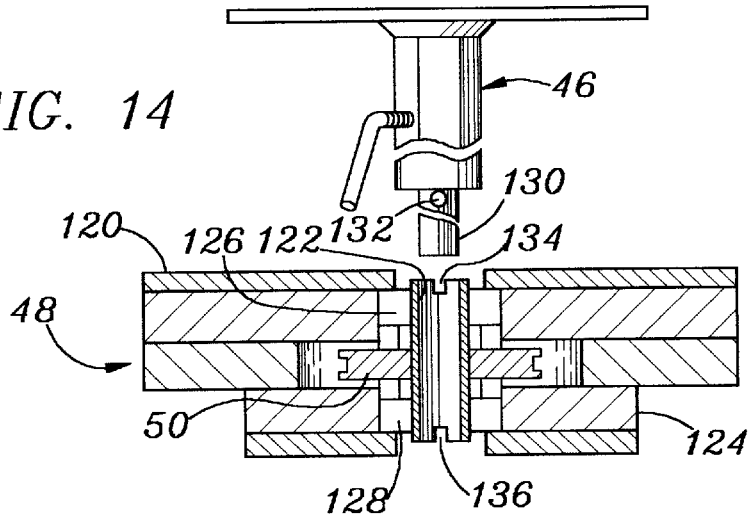
FIG. 14 is a side, cross sectional view of the trolling motor control means illustrated in FIG. 13.

Shaft 46 (FIG. 14) rotates in a reduced diameter portion 130 having a set of pins located approximately 180° apart. Interior shaft 122 has four recesses 134 at its upper end that receive pins 132 and lock chair shaft 46 and interior shaft 122 together rotationally, but allow chair 14 to be lifted and rotated 90°. Interior shaft 122 may also have four recesses 136 at its other end so that, rather than reversing cables 60, 62 chair 14 can be removed temporarily and bearing assembly 48 can simply be turned upside down to uncross cables 60, 62 and chair assembly 14 repositioned.

Alternatively, top plate 120 can carry a foot-operated on/off switch 140 (or a forward/off/reverse switch having one or more forward positions and one or more reverse positions) that can be operated by a sitting or standing user. Switch 140 is connected to motor 12 by a cable 142 and is preferably biased to an open or off position. Simple by placing his foot on switch 140 on top plate 120, pressing switch 140 to activate motor 12, and then rotating his foot to steer boat 10, the user can maneuver boat 10 as desired.

To provide for switch 140, top plate 120 is elevated and welded to a longer interior shaft 122 (FIG. 14) so that plate 120 can rotate shaft 122, but otherwise can operate in the above-described fashion. This embodiment is especially suited for a front-mounted trolling motor, where the speed control switch and reverse polarity switch are on the motor, but the motor is within reach of bearing assembly; alternatively, chair assembly 46 of FIG. 14 can be removed and the rotation of top plate 120 used to control boat 10.

Figure 15:
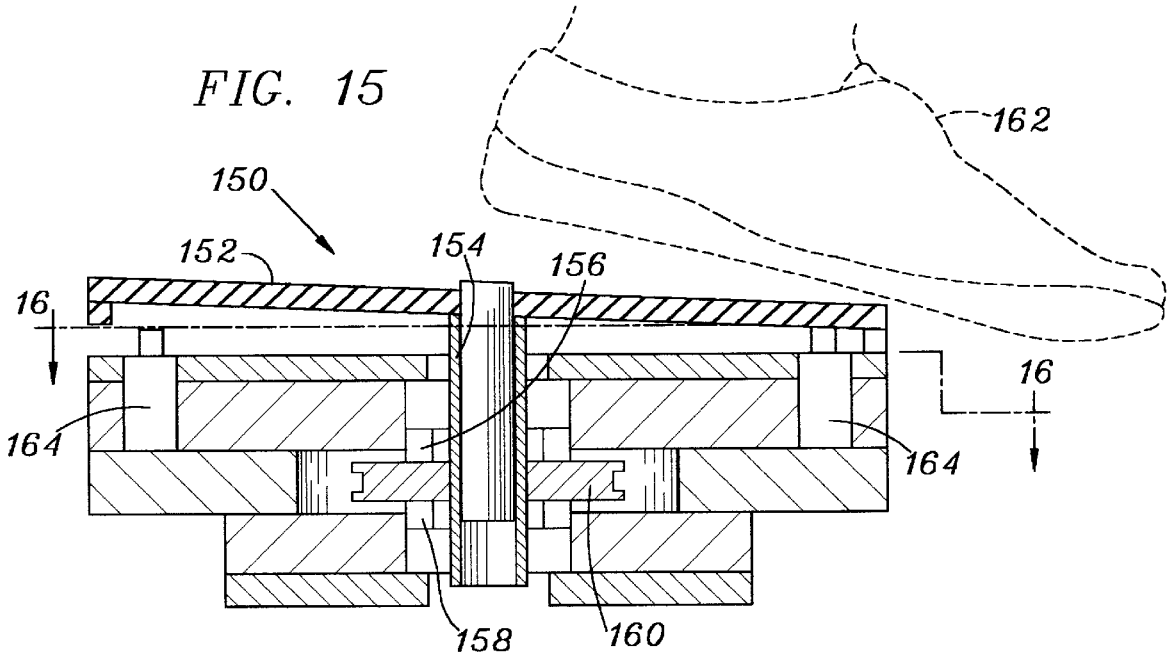
FIG. 15 is a side, cross sectional view of a means for controlling the trolling motor according to another preferred embodiment of the present invention.

In still another embodiment of the present invention, is illustrated in FIG. 15 a side, cross-sectional view of a bearing assembly 150 having a top plate 152 surrounding an interior shaft 154 that rotates freely against two bearings 156, 158 to rotate a pulley 160. In this embodiment, as in that illustrated in FIGS. 12 and 13, bearing assembly 150 is rotated using a foot 162. However, instead of one switch that is operated by pressing foot 162 directly on switch 140, there are several switches 164, preferably four switches as illustrated in FIG. 16, that are activated by pressing down anywhere along the edge of top plate 152 activates trolling motor 12; releasing the foot deactivates trolling motor 12.

Figure 16:
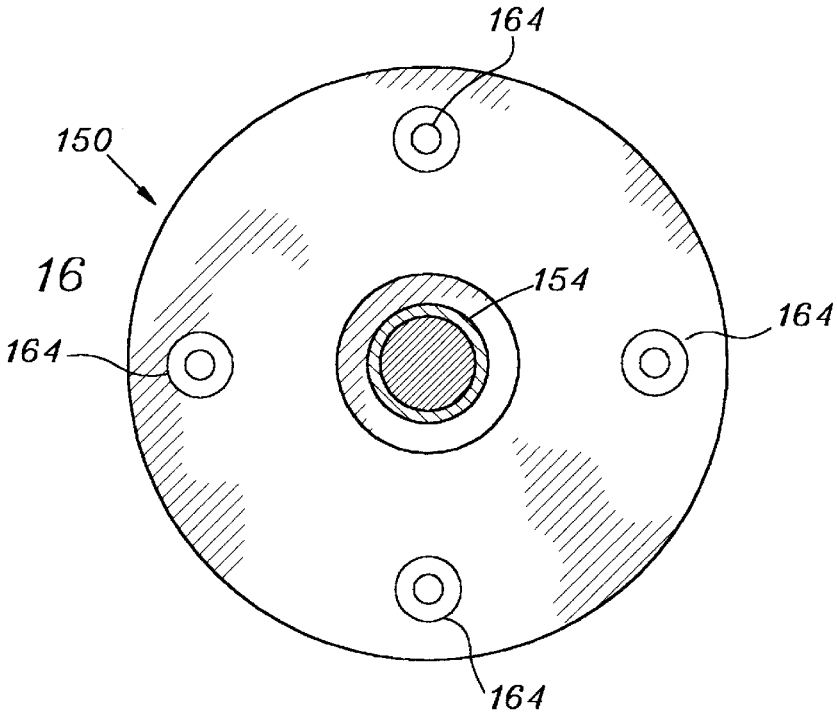
FIG. 16 illustrates the trolling motor control means of FIG. 15, taken along the lines 16—16 of FIG. 15.

In the embodiment illustrated in FIG. 15 and FIG. 16, use of a chair is optional. If used, the chair seats into interior shaft 154 and can be used to rotate bearing assembly 150 (rather than rotating the bearing assembly 150 with foot 162); however, switches 164 are still operated by the user's foot 162.

Figure 17:
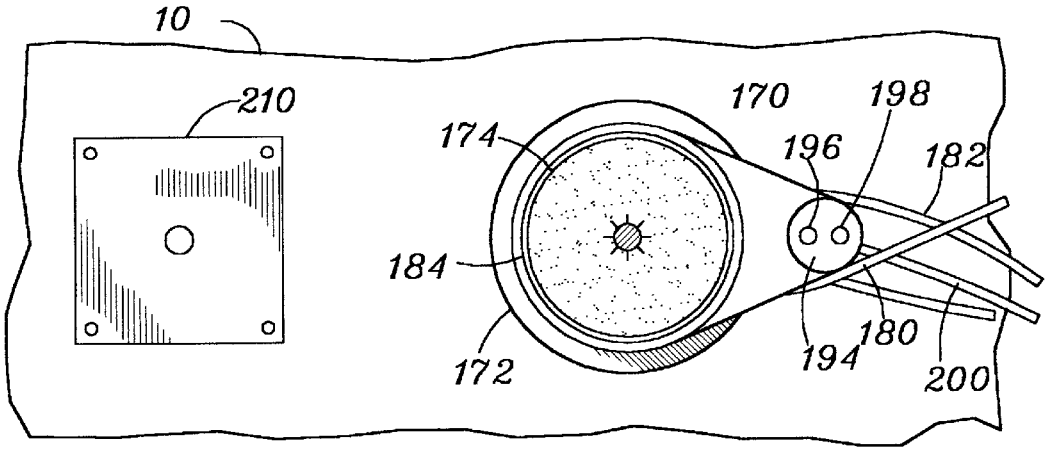
FIG. 17 is a partial top view of a boat with a trolling motor mounted to the front thereof and controlled in accordance with another preferred embodiment of the present invention, wherein the chair location can be altered from a first control position to a second control position.
Figure 18:
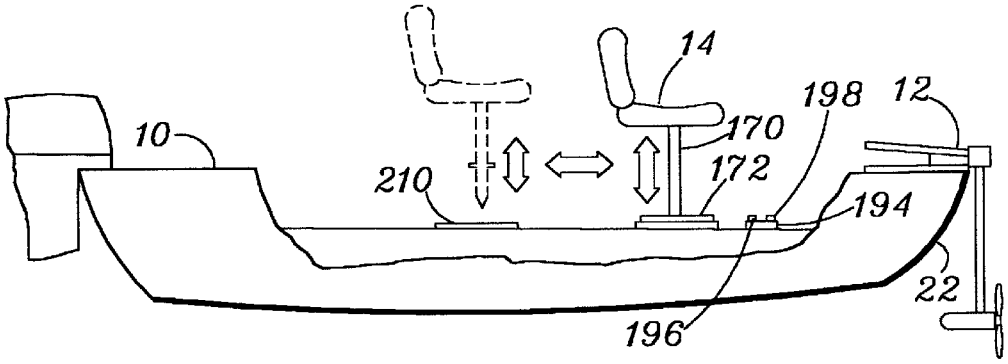
FIG. 18 is a side view, partially cut away, of a boat with first and second chair control positions as shown in FIG. 17.
Figure 19:
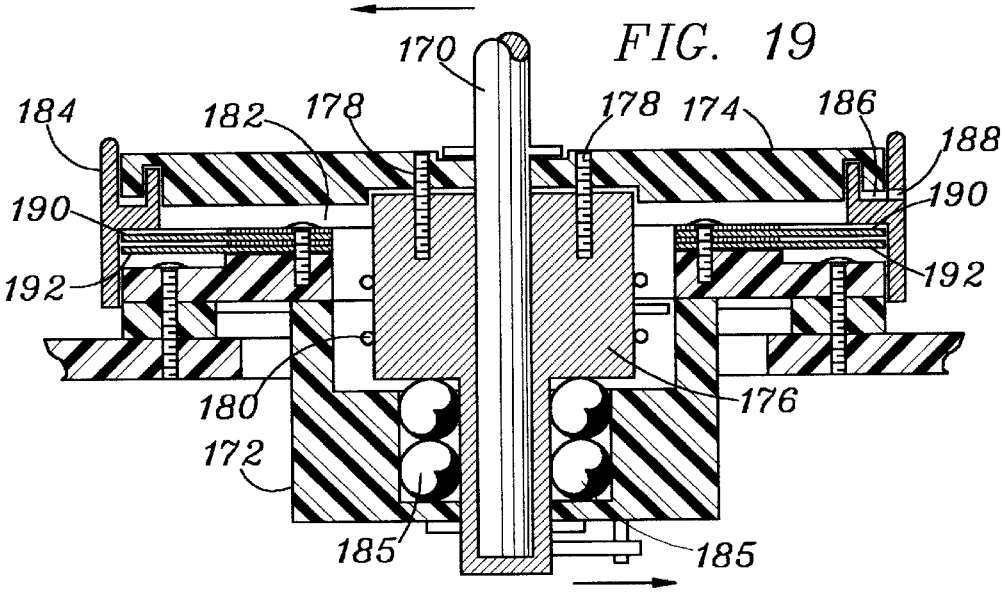
FIG. 19 is a detailed, cross-sectional view of the seating of a portion of a chair shaft in the bearing assembly, as also shown in FIGS. 17 and 18.

FIGS. 17, 18 and 19 illustrate still another embodiment of the present invention. In FIG. 18, trolling motor 12 is shown mounted to front 22 of boat 10 where it will pull boat 10. Alternatively, trolling motor 12 may be mounted to the back of boat 10 where it will push the boat. Swivel chair assembly 14 has a shaft 170 that rotates with respect to boat 10 in a bearing assembly 172. In the embodiment illustrated in these figures, the trolling motor on/off switch can be activated when the user presses with his foot on a part of the bearing assembly 172 or by tilting the chair, as will be described presently.

Bearing assembly 172 includes a plate 174, preferably made of a stiff material such as metal or a rigid plastic, and, as with the above-described bearing assembly 48, a pulley 176 (FIG. 19) attached to top plate 174 by bolts 178 and rotatable therewith, and a pair of cables 180, 182 lead to trolling motor 12. Pulley 176 rotates freely against bearings 185. When a chair is attached to bearing assembly 172, shaft 170 is attached to pulley 176. Alternately instead of the top plate 174 being attached to a bearing assembly 172 top plate 174 could be operationally connected to the control assembly 172 and have means in operational connection with the trolling motor shaft so that when the control plate 174 is rotated it will cause the trolling motor to rotate on the first axis. These means could be (1.) mechanical, (2.) electrical, or (3.) wireless electronic means such as radio frequency, infrared signals, radio or radar signals, etc. Also, bearing assembly 172 would not have to contain a pulley such as part #176. The pulley could be reconstructed so that it would be a shaft that is rotatable in the bearing 185. The shaft could have a centrally located lever attached so that a cable could be attached to each end of the lever and lead to the trolling motor's shaft so that when he shaft of the bearing assembly 170 is rotated this will cause the shaft of the trolling motor 12 to rotate in a corresponding direction. Additionally, the 2 cables could be fastened directly to the bottoms of control plate 174 so that when the control assembly rotates on a second axis this will cause the trolling motor to rotate on a first axis.

Bearing assembly 172 has a flexible, resilient cover 184, preferably made of plastic, that has three functions. First, cover 184 enables the trolling motor 12 to be turned on when the user presses down on it with the a foot. Second, cover 184 protects the interior of bearing assembly 172 from water by an annular water channel 188 that catches water and directs it from cover 184 through holes 188 (FIG. 19). Finally, cover 184 allows the user's foot to remain in one position in relation to the floor when seated and activating the on/off switch with the foot (depending on the user's orientation with respect to bearing assembly 172, he may activate the on/off switch using his heel or some other portion of his foot, or by hand). When pressed, cover 184 will not rotate, but remains in stationary contact with the user's foot when chair assembly 14 is rotated. Therefore, the user's foot that operates the on/off switch controlled by cover 184 does not have to rotate with the chair and both feet can be used to push on the deck of the boat to turn chair assembly 14.

When the user is standing or has a foot on both plate 174 and cover 184, bearing assembly 172, including both plate 174 and cover 184, rotate together to rotate trolling motor 12 for steering boat 10. However, bearing assembly 172 includes two disk contacts 190, 192 that are normally spaced apart but, when cover 184 is pressed contacts 190, 192 come together and complete an electrical circuit connected with trolling motor 12. Completing or closing the circuit results in activation of trolling motor 12. Because disks 190, 192 are biased apart, cover 184 must be pressed to keep trolling motor 12 activated. Alternatively, the circuit is closed by making contact between disk contacts 190 and 192. Once closed by pressing cover 184, the circuit could be configured to remain closed notwithstanding the release of cover 184 until contact between contacts 190, 192 is again made. Thereupon, the circuit could be opened until contact between contacts 190, 192 is made. Contacts 190 and 192 may be configured to turn with bearing assembly 172 or not, as may be preferred. Additional contacts such as 190 and 192 may also be added so as to control several speeds of trolling motor 12. The electrical contacts 190 and 192 and electric switches part #196 and 198 of FIG. 17 could be operationally connected to the trolling motor by a number of different means including (1.) electrical, (2.) wireless electronics such as radio frequency, infrared signals, (3.) radio or radar signals for activating and controlling the speeds of the trolling motor.

The user may also activate motor 12 by tilting chair 14, either by leaning back on the chair when seated or by pressing back on the chair when standing. When the user tilts chair 14, shaft 170 is deflected sideways as indicated at the top of FIG. 19, thereby deflecting plate 184 in a corresponding direction. The bottom of bearing assembly 172 then moves in the opposite, sideways direction, as indicated at the bottom of FIG. 19. When the internal components of assembly 172 are made of resilient, flexible materials, disks 190 and 192 will make contact if chair 14 is tilted far enough.

As also seen in FIGS. 17, 18, and 19 a stationary foot control 194 may include a push-button 196 which changes the direction of operation of trolling motor 12 from forward to reverse, and a knob 198 for speed control. Foot control 194 is connected electrically by cable 200 to trolling motor 12 and does not rotate with bearing assembly 172.

If desired, a base 210 can be provided for seat assembly 14, that is spaced apart from bearing assembly 172 when the user wants to control the movement and operation of trolling motor 12 entirely by foot, either while standing or while seated in a chair not coupled to the orientation of trolling motor 12. To change the location of seat assembly 14, the assembly is simply lifted from bearing assembly and moved to base 210.

Figure 20:
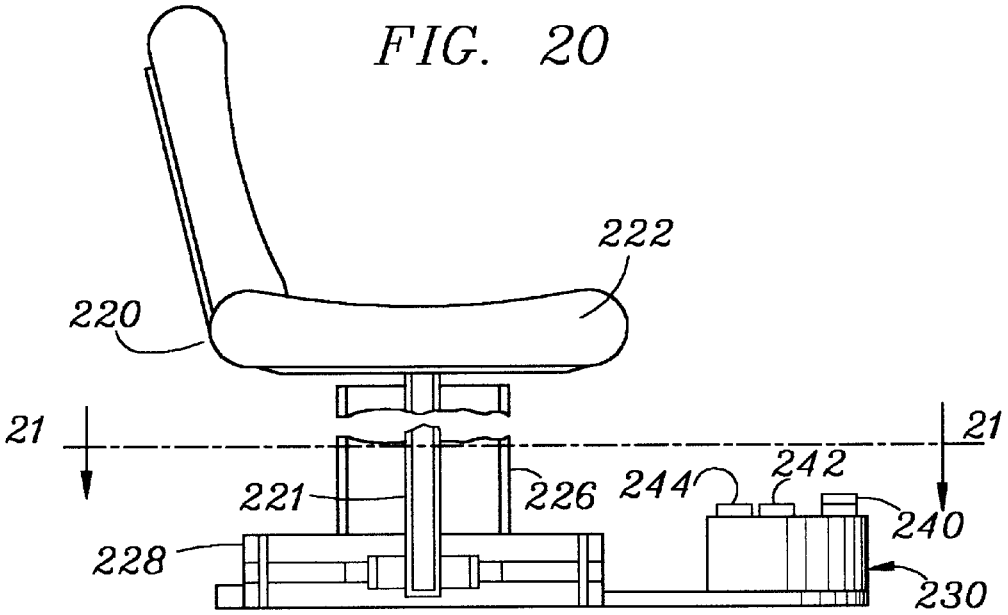
FIG. 20 shows another preferred embodiment according to the present invention, wherein operation of the trolling motor is provided by using a foot console.
Figure 21:
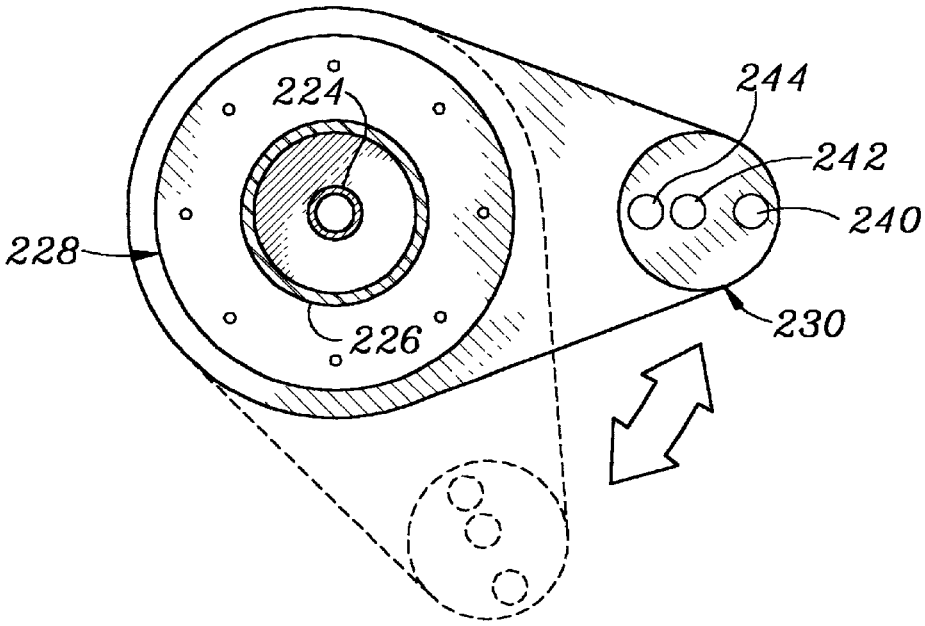
FIG. 21 shows the foot console of FIG. 20, taken along the lines 21—21 of FIG. 20.

FIGS. 20 and 21 illustrate an additional embodiment of a seat operated assembly 220 according to the present invention. Seat assembly 220 includes a foot activated control panel 230 for controlling the speeds of the trolling motor 12. In this embodiment the control panel 230 is attached to bearing assembly 228 and is rotatable independent of bearing assembly 228. For example, if the user changes the orientation of seat 222 with respect to bearing assembly 228, he may wish to change the location of control panel 230 so that switches 240, 242, 244 (FIG. 21) are more conveniently accessible.

Figure 26:
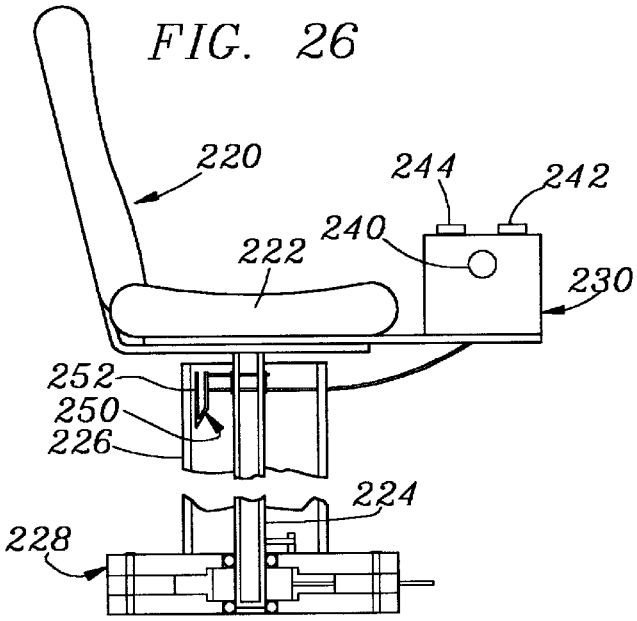
FIG. 26 is a partial cross sectional, side view of a tiltable chair-bearing assembly in accordance with another preferred embodiment of the present invention, wherein the chair can be tilted to activate the trolling motor.

Control panel 230 includes an on/off switch 240 to activate motor, a polarity switch 242 for motor direction, and a speed control knob 244. In the embodiments shown in FIGS. 20, 21 and FIG. 26, the on/off switches are preferably switches of the type that are depressed and kept depressed to keep trolling motor 12 in operation. Alternatively, the switches are locking switches of the type that are pushed once to turn motor 12 on, then pushed a second time to turn the motor off. Furthermore, rotation of bearing assembly 228 produces rotation of trolling motor 12. FIG. 26 in this embodiment control panel 230 is connected to the seat assembly 220 and rotates with the bearing assembly shaft 224.

Control panel 230 FIGS. 20, 21 and 26 includes an activation switch 240 for turning the trolling motor 12 on and off, and an activation switch 244 for operating the trolling motor in reverse polarity; and a speed control switch 242, the switch 242 can control all the speeds of the trolling motor 12 or a select speed of the trolling motor 12.

In the embodiments shown in FIGS. 19 and 26, additional control for starting and stopping trolling motor 12 is available by tilting seat 222. A contact switch 250 (FIG. 26) located within cylindrical housing 226 is closed when seat 222 is tilted. Contact switch 250 comprises a pair of leads 252 secured to shaft 224. As seat 222 is tilted, leads 252 move toward housing 226. One of leads 252 is angled so that it will contact the other lead 252 when its motion is stopped by housing 226, which remains rigidly in place on bearing assembly 228. A slight, but sufficient tilt to close switch 250 will cause the activation of trolling motor 12 as long as seat 222 is kept tilted. A more extensive tilt results in switch 250 maintaining trolling motor in operation until seat 22 is tilted to the same extent a second time, which opens the circuit driving trolling motor 12.

If desired, additional switches (one switch for each speed of trolling motor 12) may be provided. It will be evident to those of ordinary skill that such switches could readily be configured so that the speed of motor 12 is proportional to the degree of tilt of seat 222.

Figure 27:
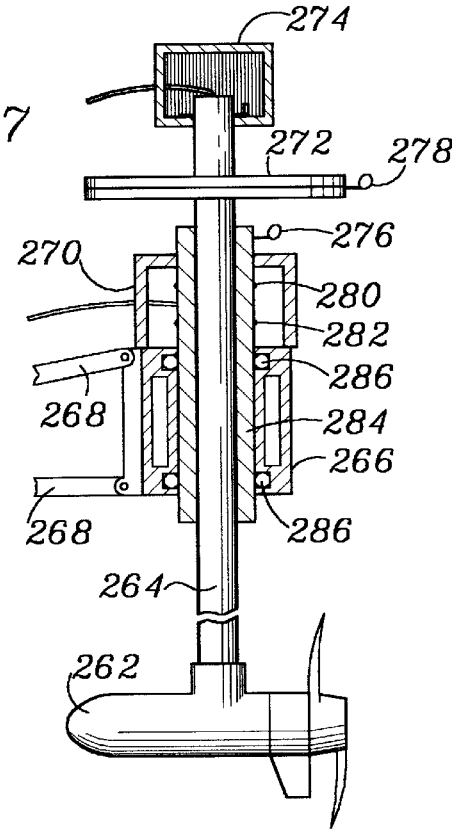
FIG. 27 is a side, cross sectional view of a trolling motor showing the motor in a decoupled position.

At times, it will be desirable to disconnect or decouple trolling motor 12 from the seat assembly control, for example, when the motor is to be retracted from the water and into the boat. The present invention includes a simple system for decoupling the motor from the seat assembly control, as illustrated in FIGS. 22, 23, 24*a*, 24*b*, 25*a*, 25*b*, and 27. FIGS. 22 and 27 show comparable views of a trolling motor 262 oriented as if in use and having a propeller assembly 262, a shaft 264, a housing 266, retraction linkages 268, a pulley housing 270, a direction plate 272, and an end cap 274. Additionally, a first key 276 is used to couple pulley 284 and direction plate 272; a second key 278 is used to indicate the orientation of propeller assembly 262.

The propeller of propeller assembly 262, which contains an electrical motor (not shown), is oriented via shaft 264 turned by cables 280 and 282 wound about pulley 284 in pulley housing 270 (shown in cross section in FIG. 27). Pulley 284 turns freely against bearings 286 in housing 266 and shaft 264 is free to slide vertically within pulley 284, and is shown lifted in FIG. 27 from the coupled position of FIG. 22 to a decoupled position. Pulley 284 and shaft 264 are coupled when first key 276 is turned so that it engages slots 290 in direction plate 272 (FIGS. 22 and 23), which couples direction plate 272 to pulley 284, and, therefore, couples the seat assembly to the trolling motor 262.

Figure 25A:
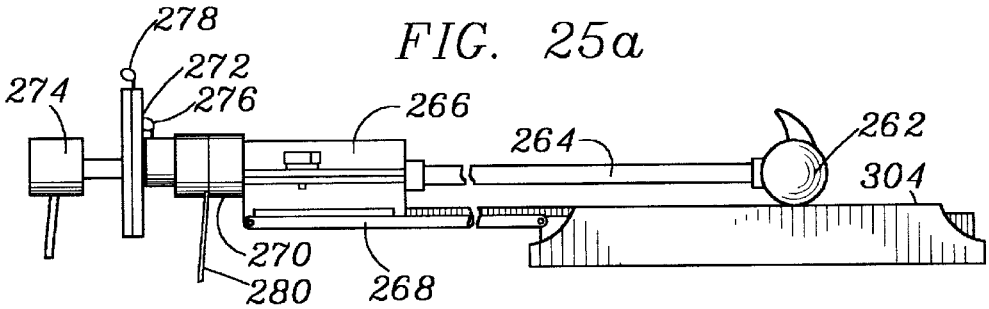
FIGS. 25*a* and 25*b* show side views of the trolling motor with the direction plate engaged and disengaged, respectively.
Figure 25B:
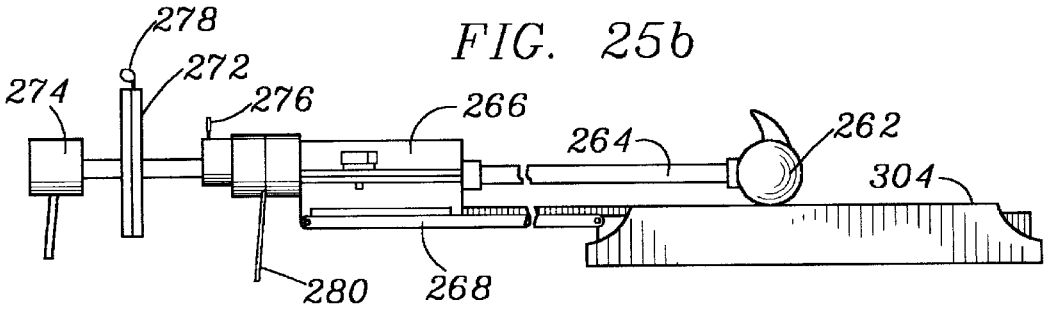

FIGS. 24*a* and 24*b*, and FIGS. 25*a* and 25*b* illustrate trolling motor 262 in the retracted position. FIGS. 24*a* and 24*b* are a top view of a portion of a boat with trolling motor 262 retracted; FIGS. 25*a* and 25*b* are side views of trolling motor 262.

FIGS. 24*a* and 24*b*, and FIGS. 25*a* and 25*b* illustrate trolling motor 262 in retracted position. FIGS. 24*a* and 24*b* are a top view of a portion of a boat with trolling motor 262 retracted; FIGS. 24*a* and 25*b* are side views of trolling motor 262 in retracted position. FIGS. 24*a* and 25*a* correspond to each other and show the direction plate 272 of trolling motor 262 in position where it is coupled to pulley 284 so that trolling motor 262 is coupled to chair 302, and therefore, because trolling motor 262 is laying in a cradle 304 and not free to rotate, chair 302 is locked in place. FIGS. 24*b* and 25*b* also correspond to each other and show direction plate 272 decoupled from pulley 284 so that trolling motor 262 is decoupled from chair 302, thereby allowing chair 302 to rotate freely about a large angle B, as indicated. When first key 276 is turned sideways so that it cannot engage slots 290, direction plate 272 can be in engagement with pulley 284, rather than separated by sliding shaft as illustrated, and the two will not be coupled except for a small amount of friction. Second key 278 always indicates the orientation of propeller assembly 262. A plurality of slots 290 may be formed in the underside of direction plate 272, allowing the relative orientation of chair 302 and trolling motor 262 to be changed if desired. FIGS. 28*a* and 28*b* illustrate still another preferred embodiment of the present invention. FIG. 28*a* shows a side view of a chair 320 in a bearing assembly 322 that carries a foot control panel 324. FIG. 28*b* is a top view taken along lines 28*b*—28*b* of FIG. 28*a*. Foot control panel 324 includes a forward/reverse switch 330, a speed control switch 332, and one or more on/off switches 334 (four switches are shown) deployed about bearing assembly 322 under a flexible, resilient activation disk 336. If preferred, switches 334 can be constructed as shown in FIG. 19.

The radial position of chair 320 is fixed with respect to bearing assembly 322, thus, chair 320 turns with the bearing assembly about the second axis. Rotation of chair 320 does not affect the position of control panel 324. The radial position of panel 324 which contains switches 330 and 332 will rotate independent of bearing assembly 322 and can be readjusted to any position in relation to the bearing assembly.

Figure 29A:
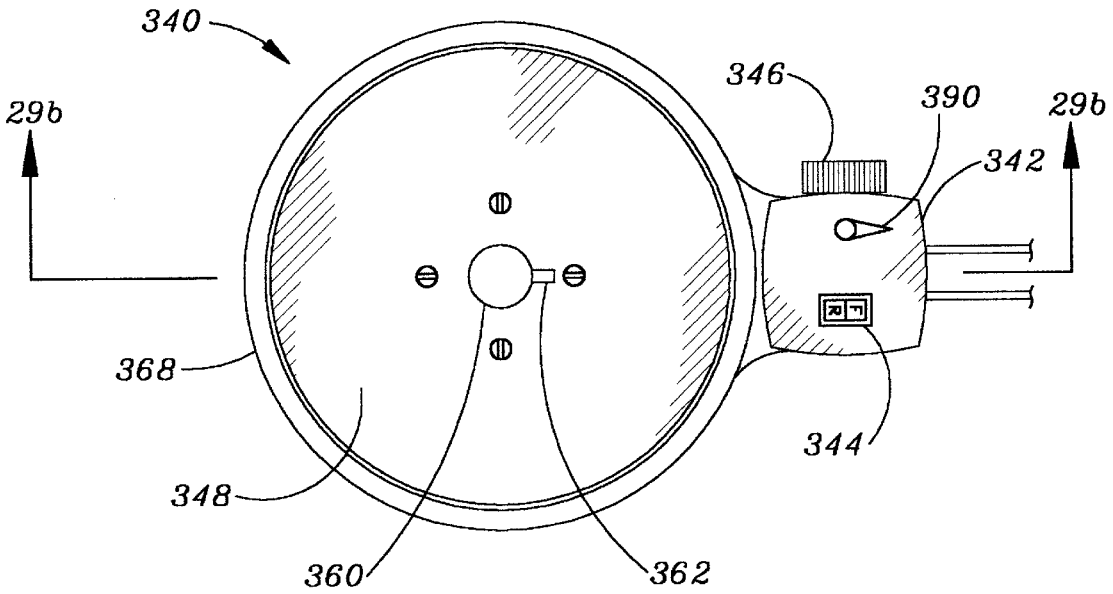
FIGS. 29*a* and 29*b* show illustrate another preferred embodiment of the present invention.

It will be apparent to those of ordinary skill that other arrangements of the various components described above are within the spirit of the present invention. Thus, FIG. 29*a* is a top view of a bearing assembly 340 with a foot control panel 342. Foot control 342 includes a forward/reverse switch 344 and a rotatable, variable speed control switch 346. Bearing assembly 340 has a cover 348 attached to a pulley 350 by at least one (preferably, a plurality) of screws or other fasteners 352 (FIG. 29*b*), one of which acts as a pulley stop when contacting a stop 354. Cover 348 and contact cover 368, like above-described cover 184 of bearing assembly 172, enables the trolling motor to be turned on when the user presses down on the outer portion of the cover. In addition cover 348 and contact cover 368 protect the interior of bearing assembly 340 from water.

Bearing assembly 340 includes a recess 360 for receiving a chair such as chair 14. If desired, recess 360 may include a single groove 362 as shown, for locking chair 14 into position with respect to bearing assembly 340. Alternatively, recess 360 could be constructed in a variety of ways, for example, the recess could be tapered or threaded, etc. to accept shaft 382 of chair support means 380 (which has been correspondingly tapered or threaded, etc.).

Pulley 350 of bearing assembly 340, like above-described bearing assembly 172, has a contact cover or ring 368, and a pair of cables 364, 366 leading to trolling motor 12. Pulley 350 rotates freely against bearings 370. Bearing assembly 340 includes two disk contacts 372, 374 that are normally spaced apart; however, when the outer portion of cover 348 (or contact cover 368) is pressed downwards, contacts 372, 374 close to complete an electrical circuit connected to trolling motor 12, activating the trolling motor. In this embodiment, disk contacts 372, 374 are fastened to bearing assembly 340; thus, the contacts do not rotate.

Contact cover 368 serves several purposes. First cover 368 floats on the uppermost contact of contacts 372, 374; second, cover 368 is used to activate trolling motor 12 as described above; and third, it serves to protect the contacts from water.

Figure 29B:
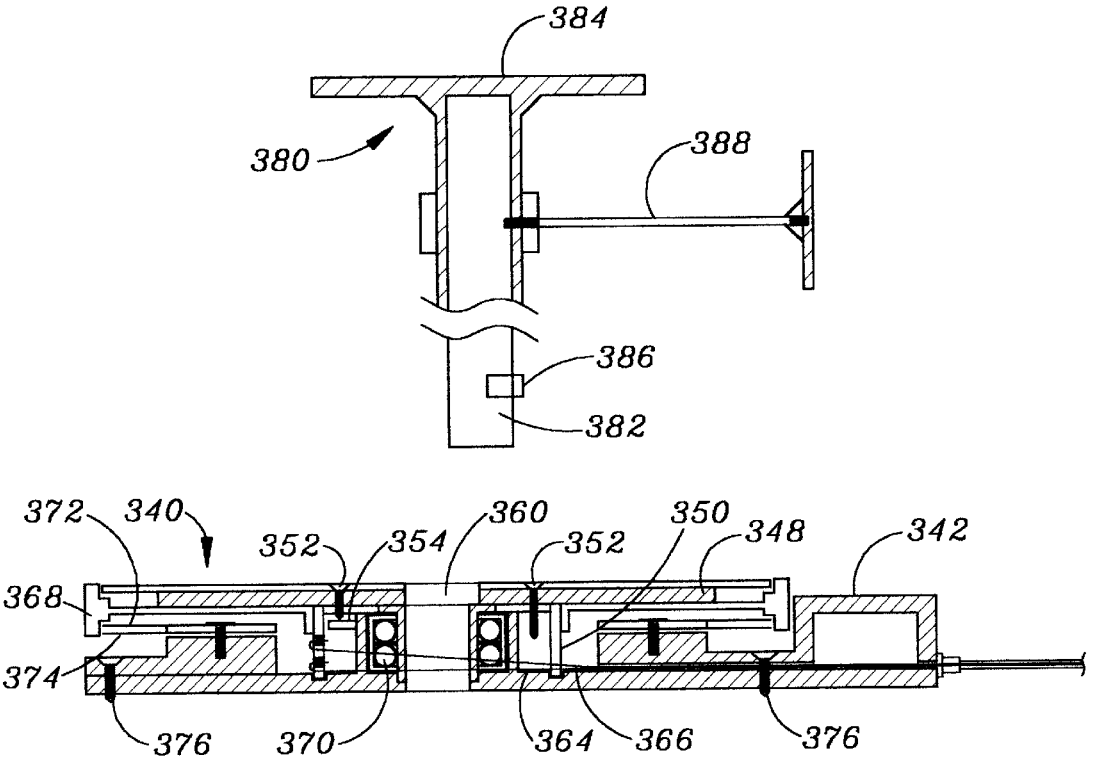

Bearing assembly 340 is approximately flat as shown in FIG. 29*b*, and attached to boat 10 with screws or other suitable means 376. Bearing assembly 340 is also configured to receive a chair support means 380 having a shaft 382, a chair base 384, and (if assembly 340 includes a groove 362) a key 386. The radial position of a chair (not shown) attached to base 384 may be adjusted via a set screw 388.

If desired, any of the above-described bearing assemblies may include an orientation indicator that shows the angle of trolling motor 12 and therefore, the direction of travel of boat 10. For example, an indicator 390 may be attached in any convenient fixed location, for example, to panel 342 (FIG. 29*a*). Indicator 390 is in operational connection with bearing assembly 340 to enable the user to visualize the angle of trolling motor 12. Indicator 390 may, of course, be placed elsewhere on boat 10 if preferred.

Figure 30A:
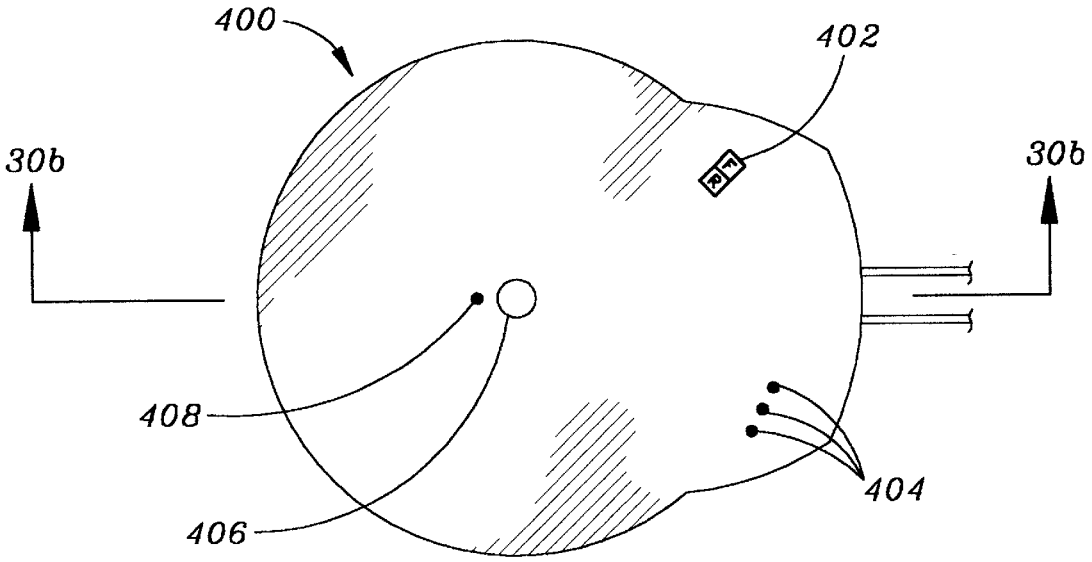
FIGS. 30*a* and 30*b* illustrate a bearing assembly according to yet another preferred embodiment of the present invention.
Figure 30B:
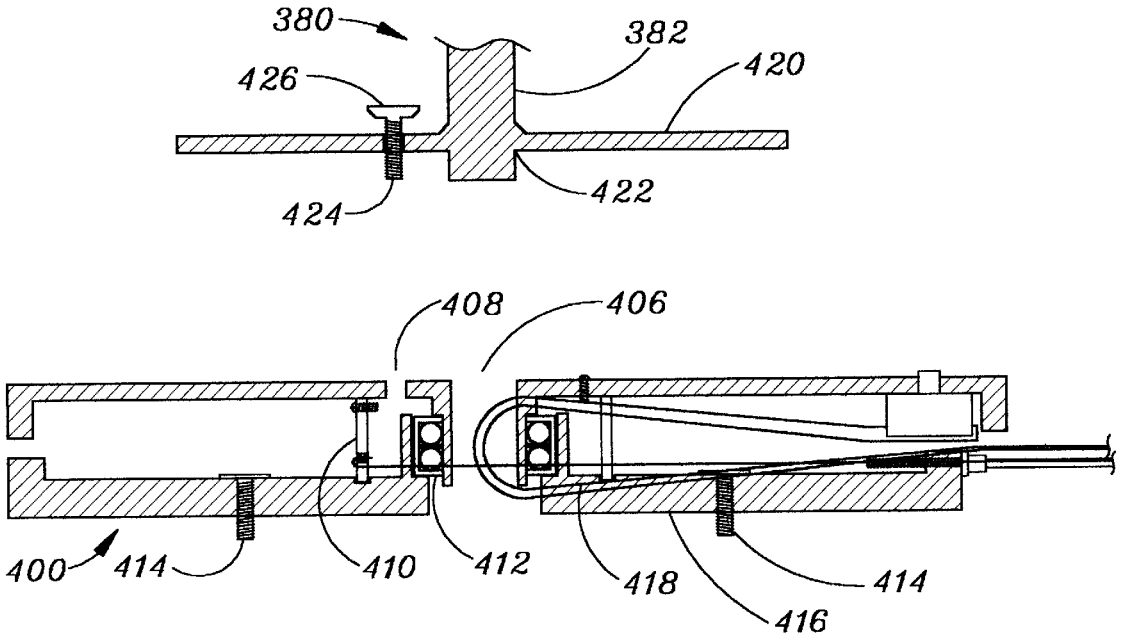

Referring now to FIGS. 30*a* and 30*b*, there are shown top and side cross-sectional views, respectively, of a bearing assembly 400 according to still another preferred embodiment of the present invention. Bearing assembly 400 includes a forward/reverse switch 402, a plurality of speed control switches 404 (one for each speed of trolling motor 12), a central hole 406 for receiving the shaft of a chair assembly, and a threaded hole 408. Switches 402 and 404 rotate with bearing assembly 400. A pulley 410 rotates on bearings 412 substantially as described above. Bearing assembly 400, like above-described bearing assembly 340, is configured to lie approximately flat against the bottom of boat 10, and may be attached to the boat by screws or bolts 414. However, bearing assembly 400 need not be attached to boat 10, alternately switches 404 and 402 could be operationally connected to the trolling motor 12 and placed near the control assembly 400 so that the switches would be accessible to at least one foot of the operator.

Bearing assembly 400 is configured to receive a chair support means such as support means 380, having a shaft 382 with a base 420 at one end and a chair base 384 (as shown in FIG. 29*b*) at the other end. Base 420 has a hole 424 which is aligned with a threaded hole 408 in bearing assembly 400 when end 422 is inserted into recess 406 and support means 380 is secured in position by a screw 426.

Figure 31A:
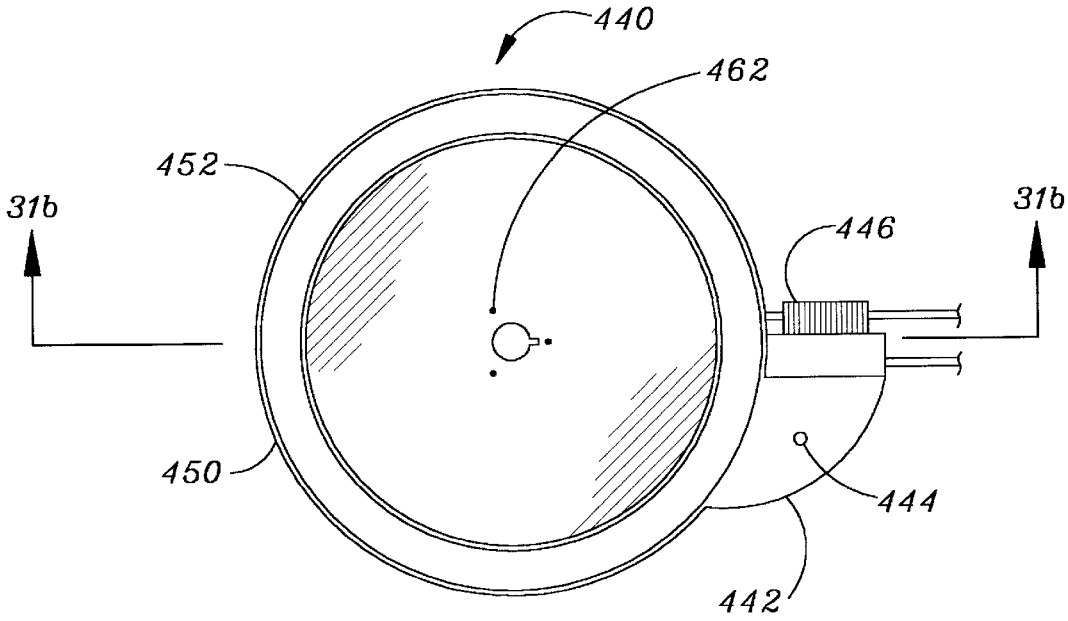
FIGS. 31*a* and 31*b* are top and side (taken along lines 31*b*—31*b* of FIG. 31*a*) views, respectively of a bearing assembly according to another preferred embodiment of the present invention.
Figure 31B:
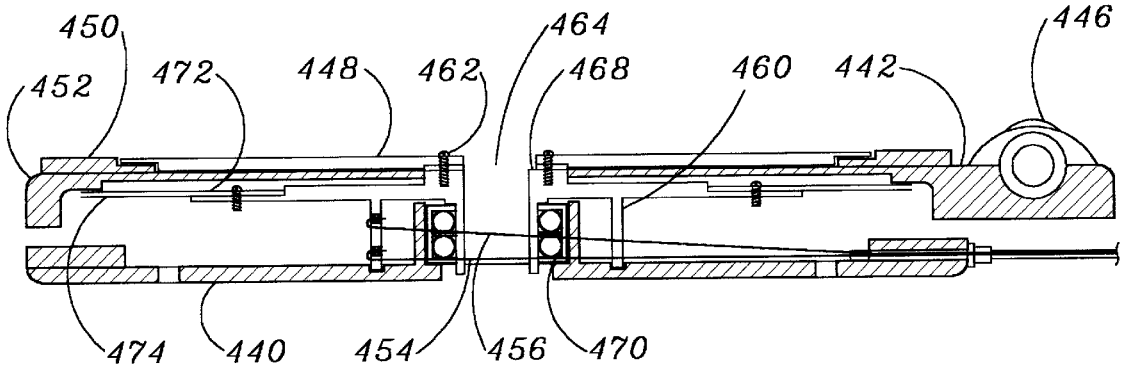

FIGS. 31*a* and 31*b* show another preferred embodiment of the present invention. A bearing assembly 440 includes a foot control panel 442 with a switch 444 and a rotatable, variable-speed control switch 446. If desired, panel 442 could include a forward/reverse switch (not shown). A cover 448 is attached to a pulley 460 by screws 462. A recess 464, which may include a groove 468, is dimensioned for receiving the shaft of a chair such as above-described chair 14. Pulley 460 rotates freely against bearings 470; a pair of cables 454, 456 lead to trolling motor 12. Two disk contacts 472, 474 are normally spaced apart; however, when the outer portion of disk 450 that floats on a disk cover 452 is pressed downwards about cover 452, the contacts close to complete an electrical circuit connected to trolling motor 12, thereby activating the trolling motor. In this embodiment of the invention, contacts 472, 474 are fastened to pulley 460 and turn with bearing assembly 440. Panel 442 is preferably integrally formed with disk cover 452, and normally turns with bearing assembly 440. However, the radial position of panel 442 may be adjusted with respect to the position of a chair attached to bearing assembly 440 if desired.

Figure 32:
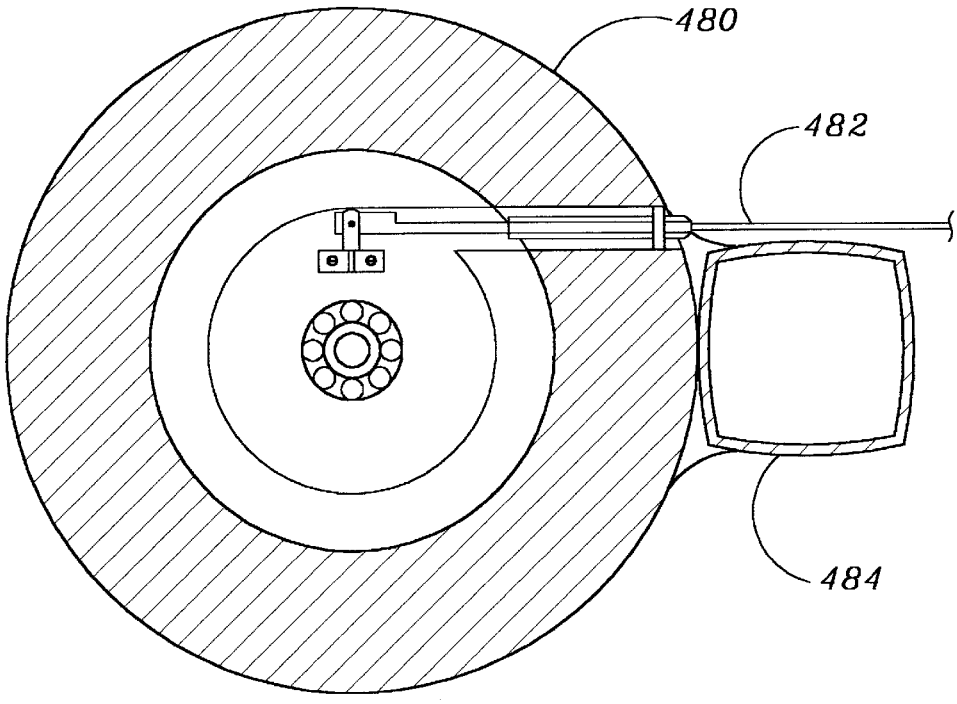
FIG. 32 is a top view of a bearing assembly connected to the trolling motor by a single cable.

As noted above, a bearing assembly according to the present invention may be connected to trolling motor 12 by one, two, or more cables. FIG. 32 shows a top, schematic view of a bearing assembly 480 connected to motor 12 by a single cable 482. Bearing assembly 480 may include a foot control 484 with forward/reverse and speed control switch as described above.

Figure 33A:
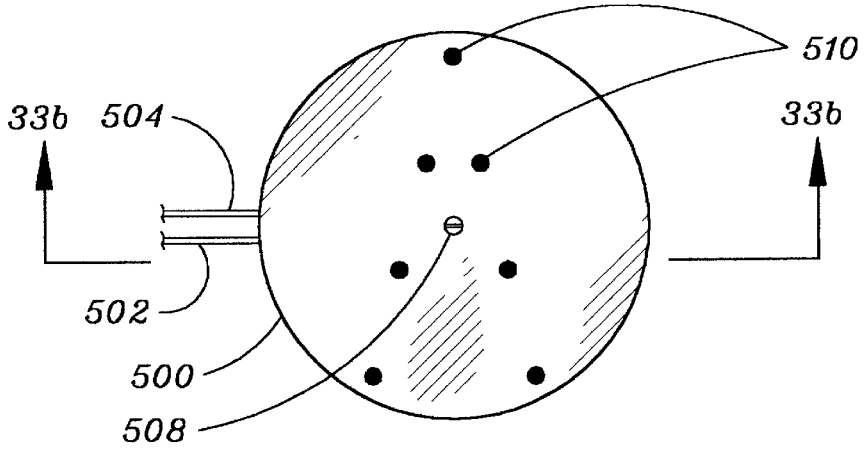
FIGS. 33*a*, 33*b*, and 33*c* show a first shaft of a trolling motor and an orientation means according to a preferred embodiment of the present invention.
Figure 33B:
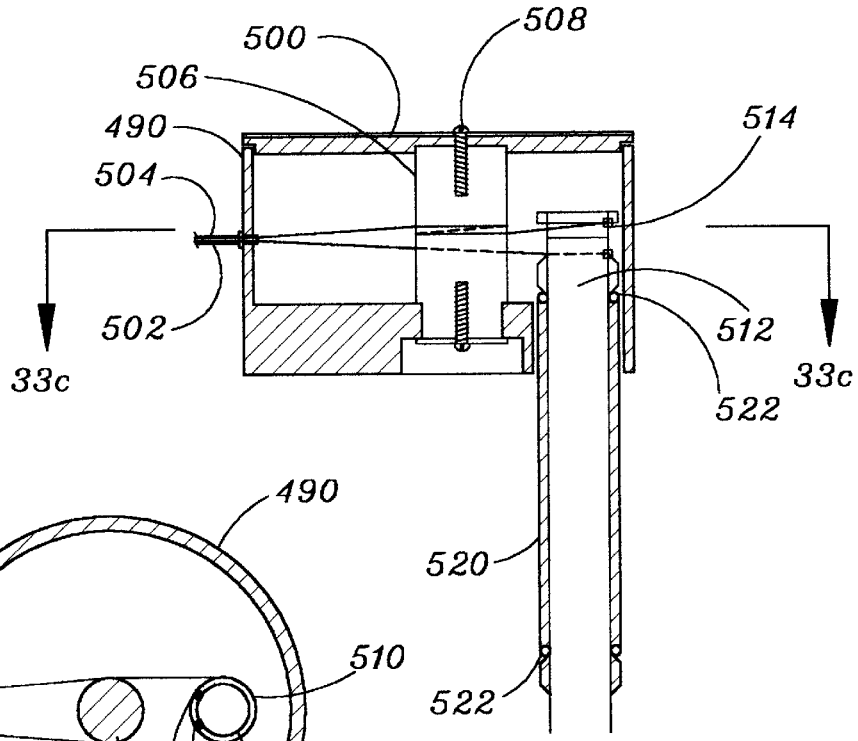
Figure 33C:
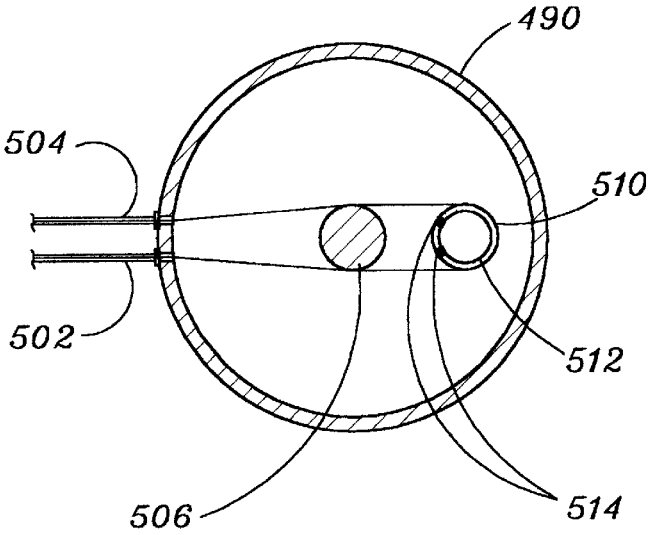

FIGS. 33*a*, 33*b*, and 33*c* represent a first shaft with an orientation means and a speed indicator means (not shown) according to a preferred embodiment of the present invention. Trolling motor 12 includes a housing 490, a top, removable cover 500 and a pair of cables 502, 504. Cover 500 is attached to a central shaft 506 by a screw 508. Cover 500 is rotatable and substantially waterproof, and carries a plurality of dots or 5 other markers 510. Dots 510 are arranged to form a directional indicator that corresponds to the angle of trolling motor 12, and therefore indicates the direction of travel of boat as cover 500 rotates on a bearing surface of housing 490.

Cables 502, 504 are attached to an inner shaft 512 by a fastening means 514, and are connected to shaft 512 as indicated in FIG. 33*c*; trolling motor 12 is attached to the other end of shaft 512. One of cables 502, 504 is wrapped around shaft 506; thus, shafts 506 and 512 rotate together. Outer housing 520 is attached to housing 490. Outer housing 520 has a bearing 522 at each end. Shaft 512 rotates freely inside bearings 522 so that when shaft 512 rotates the attached trolling motor will rotate on the first axis. Outer housing 490 also contains speed indicator means which consists of a light (not shown) for each speed of the trolling motor.

Figure 34:
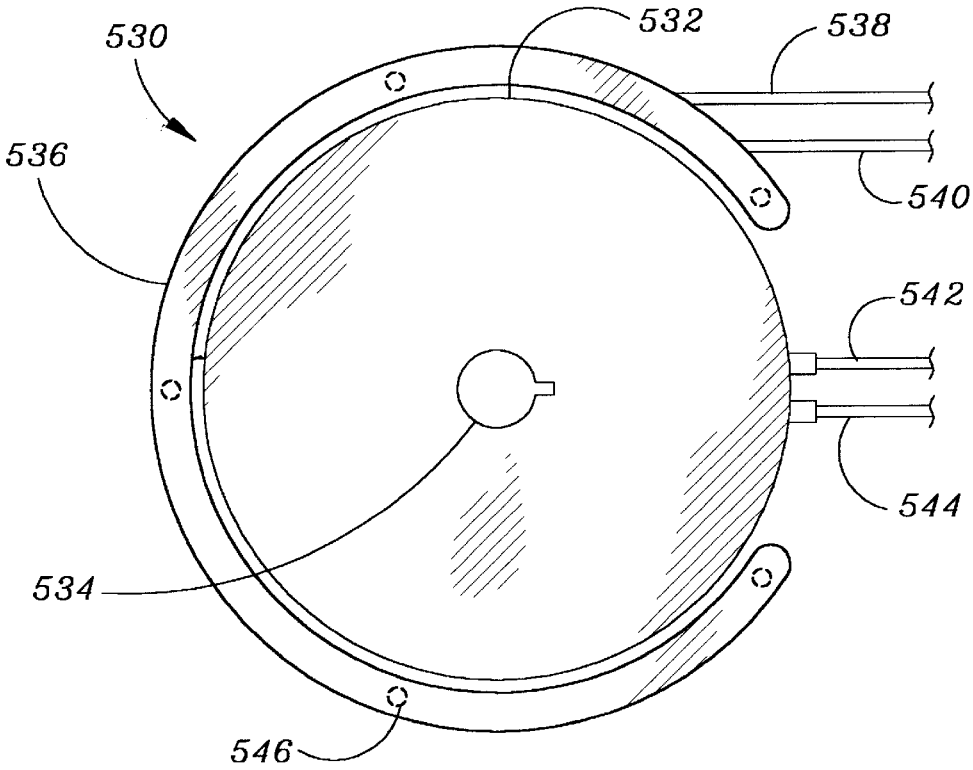
FIG. 34 is a top view of still another preferred embodiment of the present invention.

FIG. 34 illustrates a top view of an apparatus 530 according to still another preferred embodiment of the present invention, wherein a control assembly 532 with a central recess 534 for receiving an optional chair support means as shown in FIG. 29*b*, part #382. Switches 546 (5 shown) is carried by boat 10 and is positioned near control assembly 532. Cables 538, 540 electrically connect switches 546 to trolling motor 12; steering cables 542, 544 lead from control assembly 532 to the shaft of the trolling motor. Activation means cover 536 covers a plurality of switches 546 electrically connected to trolling motor 12 via cables 538, 540 alternately control assembly 532 and switches 546 could have means (other than cable) in operational connection with the trolling motor 12 for controlling the direction and speed the boat 10 travels. Trolling motor activation means 546 and the means for transferring rotation motion from the control assembly 532 to the trolling motor shaft could be operationally connected to the trolling motor by (1.) mechanical means, (2.) electrical means, (3.) wireless electronic means such as radio frequency, infrared signals, radar signals, radio signals or an other suitable means. Additionally, when a chair is attached to the control assembly part #532 a single cable, a continuous rod (not shown), or cables part #542 and 544 could be operationally connected directly to the chair so that when the chair is rotated the trolling motor shaft will rotate. The cables 542 and 544 or any other suitable means could be operationally attached to a steering wheel (not shown) which has been operationally placed on the control assembly 532 so that the rotation of the steering wheel would cause the trolling motor 12 to rotate.

It will be apparent to those skilled in the art that many changes and substitutions can be made to the preferred embodiments herein described without departing from the spirit and scope of the present invention as defined by the claims.

What is claimed is:

1. An apparatus for maneuvering a boat on water, said boat having a trolling motor with a first axis, said trolling motor rotatable about said first axis in a clockwise and a counter clockwise direction, said apparatus comprising:

a trolling motor control assembly designed to be operated by the foot of a user, and formed for receiving a chair;

means in operational connection with said control assembly and said trolling motor for transferring rotational motions of said control assembly to said trolling motor so that when said control assembly rotates about a second axis, said trolling motor rotates about said first axis; and trolling motor activating means in operational connection with said control assembly and said trolling motor, for activating at least one speed of said trolling motor.

2. The apparatus as recited in claim 1, wherein said activating means is placed in a position that at least partially surrounds said control assembly.

3. The apparatus as recited in claim 1, wherein said control assembly further consists of a bearing assembly for transferring rotational motion from said control assembly to said trolling motor so that when said control assembly rotates about a second axis said trolling motor rotates about said first axis.

4. The apparatus as recited in claim 1 wherein said means in operational connection with said control assembly and said trolling motor for transferring rotational motion of said control assembly to said trolling motor operates using mechanical means.

5. The apparatus as recited in claim 1 wherein said means in operational connections with said control assembly and said trolling motor for transferring rotational motion of said control assembly, to said trolling motor operates using electrical means.

6. The apparatus as recited in claim 1 wherein said means in operational connection with said control assembly and said trolling motor for transferring rotational motion of said control assembly to said trolling motor operates using wireless electronics means as in, but not exclusively, radio signals, infrared signals, or radar signals.

7. The apparatus as recited in claim 1 wherein said trolling motor activating means in operational connection with said control assembly and said trolling motor for activating at least one speed of said trolling motor operates using electrical means.

8. The apparatus as recited in claim 1 wherein said trolling motor activating means in operational connection with said control assembly and said trolling motor for activating at least one speed of said trolling motor operates using wireless electronic means.

9. The apparatus as recited in claim 8 wherein said wireless electronic means operates using radio signals.

10. The apparatus as recited in claim 8 wherein said wireless electronic means operates using infrared signals.

11. The apparatus as recited in claim 8 wherein said wireless electronic means operates using radar signals.

12. An apparatus for maneuvering a boat on water, said boat having a trolling motor with a first axis, said trolling motor rotatable about said first axis in a clockwise and a counter-clockwise direction, said apparatus comprising:

a control assembly for controlling rotation of said trolling motor about said first axis, and a speed control assembly for activating at least one speed of said trolling motor, said speed control assembly is placed at least partially around said control assembly; and means for operationally connecting said speed control assembly to said trolling motor.

13. The apparatus as recited in claim 12 wherein said control assembly is foot operable to control rotation of said trolling motor about said first axis.

14. The apparatus as recited in claim 12 wherein said control assembly further comprises a chair so that an operator can rotate said chair to control rotation of said trolling motor about said first axis.

15. The apparatus as recited in claim 12 wherein means for operationally connecting said speed control assembly to said trolling motor further comprises electrical means.

16. The apparatus as recited in claim 12 wherein means for operationally connecting said speed control assembly to said trolling motor further comprises wireless electronic means.

17. The apparatus as recited in claim 12 further comprising a speed indicator means containing a light for each speed of said trolling motor;

said speed indicator means operatively connected to said trolling motor.

18. An apparatus for maneuvering a boat on water, said boat having a trolling motor with a first axis, said trolling motor rotatable about said first axis in a clockwise and a counter clockwise direction, said apparatus comprising:

a trolling motor control assembly including chair support means;

means in operational connection with said control assembly and said trolling motor for transferring rotational motion of said control assembly to said trolling motor so that when said control assembly rotates about a second axis said trolling motor rotates about said first axis; and a plurality of trolling motor activation switches, one switch for each desired speed of said trolling motor, said switches in electrical connection with said trolling motor for activating the speeds of said trolling motor, said switches positioned remotely from said control assembly so that said switches are accessible to the foot of an operator.

19. The apparatus as recited in claim 18 wherein said trolling motor control assembly is designed to be operated by the foot of a user.

20. The apparatus as recited in claim 18 wherein said activating means further comprises a plurality of electrical switches, one for each speed of said trolling motor;

said plurality of switches being in electrical connection with said trolling motor for activating a plurality of trolling motor speeds.

21. The apparatus as recited in claim 18 wherein said activating means further comprises a bar strategically placed adjacent to said control assembly, so that when an operator is seated in a chair that has been placed on said chair support means, said bar is accessible to the operator's foot regardless of how far the chair has to be rotated to steer the boat in all directions.

22. The apparatus as recited in claim 18 wherein said activating means further comprises more than one electrical switch that has been strategically placed so that at least one speed of said trolling motor may be controlled by the foot of an operator regardless of how far the chair which has been attached to said chair support means has to be rotated to steer said boat in all directions.

23. The apparatus as recited in claim 18 wherein said chair support means further comprises a chair; said chair having mechanical means in operational connection with said trolling motor so that when said chair rotates on said second axis, said trolling motor rotates on said first axis.

24. An apparatus for maneuvering a boat on water, said boat having a trolling motor with a first axis, said trolling motor rotatable about said first axis in a clockwise and a counter clockwise direction, said apparatus comprising:

a foot-operable trolling motor control assembly, said control assembly having a control plate rotatable about a second axis on an approximately horizontal plane;

trolling motor activation means consisting of a separate switch for each speed of said trolling motor, said switches in electrical connection with said trolling motor for activating the speeds of said trolling motor;

transferring means in operational connection with said plate and said trolling motor so that, when said plate rotates about said second axis, said trolling motor rotates about said first axis.

25. The apparatus as recited in claim 24 wherein said trolling motor control assembly further comprises a first cable for rotating said trolling motor in said counter clockwise direction and a second cable for rotating said trolling motor in said clockwise direction.

26. An apparatus for maneuvering a boat on water, said boat having a trolling motor with a first axis, said trolling motor rotatable about said first axis in a clockwise and a counter clockwise direction, said apparatus comprising:

a foot operable trolling motor control assembly, said control assembly having a control plate rotatable on a second axis; and trolling motor activating means consisting of a separate switch for each speed of said trolling motor, said switches positioned on said control plate, said activating means in operational connection with said trolling motor for activating a plurality of speeds of said trolling motor; and transferring means in operational connection with said control plate and said trolling motor so that, when said control plate rotates on said second axis; said trolling motor rotates on said first axis.

27. The apparatus as recited in claim 26 wherein said control plate is rotatable on an approximately vertical plane.

28. An apparatus for maneuvering a boat on water, said boat having a trolling motor with a first axis, said trolling motor rotatable about said first axis in a clockwise and a counter clockwise direction, said apparatus comprising;

a trolling motor control assembly;

means in operational connection with said control assembly and said trolling motor for rotating said trolling motor on said first axis; and trolling motor activation means consisting of a separate switch for each speed of said trolling motor, said switches positioned for use by the foot of an operator, said switches in operational connection with said trolling motor for activating the speeds of said trolling motor.

29. An apparatus for maneuvering a boat on water, said boat having a trolling motor with a first axis, said trolling motor rotatable about said first axis in a clockwise and a counter clockwise direction, said apparatus comprising:

a trolling motor control assembly;

means in operational connection with said control assembly and said trolling motor for rotating said trolling motor on said first axis; and a trolling motor activation switch positioned for use by the foot of a user, said switch in electrical connection with said trolling motor for activating a plurality of speeds of said trolling motor, said switch operable to activate and control said trolling motor speeds by the application of downward pressure by the foot of said user, by pressing lightly for a first speed, pressing increasingly harder for obtaining all desired speeds of said trolling motor, while actively steering boat without needing to reposition said foot on, or remove said foot from, said switch, said trolling motor being deactivated upon the release of said downward pressure.

30. The apparatus as recited in claim 29 further consists of a rotatable control assembly with means for transferring rotational motion of said control assembly to said trolling motor so that when said control assembly rotates on a second axis said trolling motor rotates on said first axis.

31. An apparatus for maneuvering a boat on water, said boat having a trolling motor with a first axis, said trolling motor rotatable about said first axis in a clockwise and a counter clockwise direction, said apparatus comprising:

a trolling motor control assembly having a chair rotatable about a second axis on an approximately horizontal plane; and trolling motor activation means for activating at least one speed of said trolling motor, said activation means positioned for use by the foot of an operator;

transferring means consisting of cable means in operational connection with said chair and said trolling motor, said cable means at least partially enclosed in cable guide means, said cable guide means constructed to lead said cable means from said control assembly to said trolling motor so that when said chair rotates about said second axis, said trolling motor rotates about said first axis.

32. The apparatus as recited in claim 31 wherein said cable guide means further consists of cable housing means.

33. The apparatus as recited in claim 31 wherein said cable guide means further consists of flexible cable housing means.

34. The apparatus as recited in claim 31 wherein said cable guide means further consists of pulley means.

35. An apparatus for controlling a trolling motor, said trolling motor installed on a boat so that said trolling motor is rotatable about a first axis, said apparatus comprising:

a control assembly having a second shaft with a second axis, said control assembly rotatable about said second axis;

means formed in said control assembly for receiving an optional chair support means, said chair support means being removable by a user;

means in operational connection with said control assembly and said trolling motor, for transferring rotational motion of said second shaft to said trolling motor so that when said second shaft rotates about said second axis, said trolling motor rotates about said first axis; and means for activating said trolling motor, said activating means in electrical connection with said trolling motor so that, when a user is seated in a chair secured to said chair support means, said activating means is operable by the foot of a user to activate said trolling motor and said boat is steerable by rotating said chair.

* * * * *